US009188096B2

(12) United States Patent
Usui et al.

(10) Patent No.: US 9,188,096 B2
(45) Date of Patent: Nov. 17, 2015

(54) FUEL PUMP AND FUEL SUPPLY SYSTEM OF INTERNAL COMBUSTION ENGINE

(75) Inventors: Takashi Usui, Toyota (JP); Tomoyuki Maeda, Nagoya (JP); Kazuhiro Asayama, Nagoya (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 709 days.

(21) Appl. No.: 13/581,698

(22) PCT Filed: Sep. 6, 2011

(86) PCT No.: PCT/JP2011/004983

§ 371 (c)(1),
(2), (4) Date: Aug. 29, 2012

(87) PCT Pub. No.: WO2013/035132

PCT Pub. Date: Mar. 14, 2013

(65) Prior Publication Data

US 2013/0098338 A1 Apr. 25, 2013

(51) Int. Cl.

*F02M 37/20* (2006.01)
*F02M 69/02* (2006.01)
*F02M 59/44* (2006.01)
(Continued)

(52) U.S. Cl.

CPC ..... *F02M 69/02* (2013.01); *F02M 37/20* (2013.01); *F02M 59/44* (2013.01); *F02M 63/0265* (2013.01); *F02M 59/368* (2013.01); *F02M 59/462* (2013.01); *F02M 2200/40* (2013.01)

(58) Field of Classification Search

CPC ..... F02M 37/20; F02M 37/22; F02M 39/005
USPC ..... 123/445, 446, 447, 516; 417/503
See application file for complete search history.

(56) References Cited

U.S. PATENT DOCUMENTS 4,441,868 A * 4/1984 Fiedler et al. ..... 417/490
4,625,694 A * 12/1986 Adey et al. ..... 123/450
(Continued)

FOREIGN PATENT DOCUMENTS

CN 101109347 A 1/2008
CN 101311523 A 11/2008
(Continued)

OTHER PUBLICATIONS

International Search Report of PCT/JP2011/004983 mailed Dec. 13, 2011.

*Primary Examiner* — Thomas Moulis
(74) *Attorney, Agent, or Firm* — Kenyon & Kenyon LLP

(57) ABSTRACT

A fuel pump which can suppress fuel bubbles from being sucked into a fuel pressure chamber, and can achieve a stable fuel pressure property. The fuel pump has a pump body formed with a suction passage and a pump operation chamber, and a pressure pump mechanism to pressurize and discharge fuel. The pump body has a lower side wall portion and an upper side wall portion respectively at the vertically lower and upper sides of the inner wall portion forming a suction gallery chamber partly forming the suction passage. The pressure pump mechanism has a valve retaining member having an insertion portion inserted into the suction gallery chamber. The insertion portion has internal suction inlets through which the fuel is sucked from the suction gallery chamber into the pump operation chamber, the internal suction inlets being positioned in the intermediate height area in the suction gallery chamber.

10 Claims, 12 Drawing Sheets

(51) Int. Cl.

| | |
|---|---|
| ***F02M 63/02*** | (2006.01) |
| *F02M 59/36* | (2006.01) |
| *F02M 59/46* | (2006.01) |

(56) References Cited

U.S. PATENT DOCUMENTS

| | | | | | |
|---|---|---|---|---|---|
| 5,701,873 | A | * | 12/1997 | Schneider | 123/516 |
| 6,016,790 | A | * | 1/2000 | Makino et al. | 123/496 |
| 6,325,051 | B1 | * | 12/2001 | Oomori et al. | 123/516 |
| 2007/0110603 | A1 | * | 5/2007 | Usui et al. | 417/505 |
| 2007/0251499 | A1 | * | 11/2007 | De Luca et al. | 123/446 |
| 2008/0019853 | A1 | | 1/2008 | Hashida et al. | |
| 2008/0289713 | A1 | | 11/2008 | Munakata et al. | |
| 2011/0110807 | A1 | | 5/2011 | Kobayashi et al. | |

FOREIGN PATENT DOCUMENTS

| | | | |
|---|---|---|---|
| EP | 1 614 890 | A1 | 1/2006 |
| JP | 09-303227 | A | 11/1997 |
| JP | 2004-316536 | A | 11/2004 |
| JP | 2008-286144 | A | 11/2008 |
| JP | 2010-007564 | A | 1/2010 |
| JP | 2010-190104 | A | 9/2010 |
| JP | 2010-190106 | A | 9/2010 |
| JP | 2010-216466 | A | 9/2010 |
| JP | 2011-027041 | A | 2/2011 |

* cited by examiner

FUEL PUMP AND FUEL SUPPLY SYSTEM OF INTERNAL COMBUSTION ENGINE

This is a 371 national phase application of PCT/JP2011/004983 filed 6 Sep. 2011, the contents of which are incorporated herein by reference.

TECHNICAL FIELD

The present invention relates to a fuel pump and a fuel supply system of an internal combustion engine, and more particularly to a fuel pump suitable for pressurizing fuel for an internal combustion engine to a high pressure at which the fuel can be injected into a cylinder, and to a fuel supply system of an internal combustion engine provided with the fuel pump.

BACKGROUND ART

In recent years, there have been proposed two types of fuel injection devices one of which is adapted to directly inject fuel into a cylinder, and the other of which is designed to jointly use the methods of directly injecting the fuel into the cylinder and injecting the fuel into an intake port.

From the point of view it is necessary to pressurize the fuel to the high pressure and supply the fuel to a fuel injection valve (injector) used for injecting the fuel into the cylinder, there has so far been employed a fuel supply system that supplies the fuel at the high pressure which is produced by even further pressurizing the fuel with the help of a fuel pump used for pressuring the fuel from a feed pump.

As the fuel pump for use in supplying the fuel at the high pressure and the fuel supply system of this kind, there have so far been employed many kinds of fuel pumps and fuel supply systems each of which comprises a pump body (pump housing), a pressurizing plunger mounted on the pump body to be reciprocatable with respect to the pump body, and a pump drive cam driven by the rotational force of the internal combustion engine to reciprocate the plunger. The high pressurized fuel pump thus constructed has a fuel accommodation unit with a damper and capable of intermittently sucking the fuel by the reciprocation motions of the plunger. There have so far been also proposed many types of fuel pumps each of which comprises an auxiliary chamber variable in volume in response to the reciprocation motions of the plunger, and a fuel galley chamber held in communication with the auxiliary chamber.

More concretely, for example known is an apparatus which comprises a pump body having an upper portion formed with a fuel galley formed in a cylindrical shape. The pump body has a lower wall portion forming an inner bottom surface of the fuel gallery chamber and formed with an inlet opening through which the fuel is introduced into the fuel gallery (see for example Patent Document 1).

Further, another known apparatus comprises a pressure adjustment valve capable of adjusting the fuel supply pressure from a low pressure pump to a high pressure pump and the back pressure of the high pressure pump, and a pressure control valve capable of adjusting the discharge pressure of the high pressure pump to a preliminarily set delivery pressure. The relief set pressure of the pressure control valve is set to have a value equal to or larger than a saturated steam pressure corresponding to the maximum temperature of the internal combustion engine after the stoppage of the internal combustion engine (see for example Patent Document 2).

Furthermore, still another known apparatus is proposed to enhance fuel introduction efficiency, and formed with a fuel gallery allowing a lateral flow to be formed toward a suction opening to a pressure chamber side by the fuel introduced through an inlet opening and the fuel introduced from an auxiliary chamber when a plunger is retracted. The suction direction of the fuel from the suction opening to the pressure chamber side is set at an acute angle with respect to the lateral flow (see for example Patent Document 3).

CITATION LIST

Patent Literature

PTL1

Patent Document 1: Japanese Patent Application Publication No. 2010-190104

PTL2

Patent Document 2: Japanese Patent Application Publication No. 1997-303227

PTL3

Patent Document 3: Japanese Patent Application Publication No. 2010-190106

SUMMARY OF INVENTION

Technical Problems

The conventional fuel pump as previously mentioned is, however, easy to generate fuel vapor (hereinafter also referred to as fuel bubbles) at a high temperature side portion among in the inner wall forming the fuel gallery chamber. Further the gallery chamber has a small volume and a low height in the vertical direction thereof, thereby resulting in causing a possibility that the fuel bubbles stored in the vicinity of the upper wall surface portion among in the inner wall of the fuel gallery chamber is sucked into the pressure chamber of the high pressurized fuel pump.

Especially when the high pressurized fuel pump is driven by a drive cam from the internal combustion engine side, the temperature of the fuel is raised at the inner low wall portion of the fuel gallery chamber to boost the saturated steam pressure of the fuel, thereby resulting in facilitating the high temperature fuel reaching the saturated steam pressure to evaporate. The fuel vapor generated at the inner low wall portion of the fuel gallery chamber and stored at the upper portion of the fuel gallery chamber causes a possibility that the fuel vapor is sucked into the pressure chamber of the high pressurized fuel pump from an inlet opening portion in the neighborhood of the upper portion of the fuel gallery chamber.

Therefore, the fuel supply system using the conventional fuel pump as a fuel pressure pump tends to suck fuel vapor into the fuel pressure chamber, thereby leading to a possibility that the supply property of the pressurized fuel is lowered.

For this reason, the present invention has an object to provide a fuel pump which can effectively suppress fuel bubbles from being sucked into the fuel pressure chamber and to achieve a stable fuel pressure property, as well as to provide a fuel supply system of an internal combustion engine which can enhance the supply property of the pressurized fuel by using the above fuel pump.

Solution to Problem

For solving the previously mentioned problems, (1) the fuel pump according to the present invention is provided with a pump body and a pressure pump mechanism, the pump body being formed with a fuel introduction passage to introduce fuel from the outside and a pump operation chamber to introduce the fuel through the fuel introduction passage, and the pressure pump mechanism having an input portion having power inputted from the outside and discharging the fuel pressurized in a fuel pressure chamber formed in the pump operation chamber when the power is inputted to the input portion, the pump body having a fuel storage chamber forming part of the fuel introduction passage, a lower side wall portion positioned at a vertically lower side of an inner wall portion partly forming the fuel storage chamber, and an upper side wall portion positioned at a vertically upper side of the inner wall portion partly forming the fuel storage chamber, the pressure pump mechanism having an insertion portion inserted in the fuel storage chamber of the pump body to be positioned vertically between the lower side wall portion and the upper side wall portion of the pump body, the insertion portion having an internal suction inlet in the vertically intermediate height area in the fuel storage chamber to suck the fuel into the pump operation chamber from the fuel storage chamber.

When the fuel bubbles are generated from the fuel held in contact with the lower side wall portion at the lower side of the insertion portion of the pressure pump mechanism in the fuel storage chamber, the fuel bubbles rising by buoyancy are easy to be stored at the upper side of the insertion portion. The vertically intermediate height area of the insertion portion disposed allows the fuel bubbles to pass therethrough, but is difficult to allow the fuel bubbles to be stored thereat, thereby leading to a small amount of fuel bubbles to be stored in the vertically intermediate height area of the insertion portion. The insertion portion of the pressure pump mechanism is formed with the internal suction inlet in the vertically intermediate height area to allow the fuel to be sucked into the pump operation chamber. The above construction of the fuel pump according to the present invention makes it possible to direct the progression pathways of the fuel bubbles generated and rising at the lower side wall portion away from the internal suction inlet by the insertion portion in the fuel storage chamber as well as to easily dispose the internal suction inlet at the position out of the progression pathways of the fuel bubbles. As result, above construction of the fuel pump according to the present invention makes it possible to effectively suppress the fuel bubbles from being sucked into the internal suction inlet.

In the fuel pump according to the present invention as set forth in the above definition, (2) the lower side wall portion preferably receives heat from the outside to become a high temperature side wall portion in the pump body. In this construction, the fuel bubbles are easily generated from the fuel held in contact with the lower side wall portion. However, the progression pathways of the fuel bubbles generated and rising at the lower side wall portion is directed away from the internal suction inlet by the insertion portion in the fuel storage chamber, thereby making it possible to effectively suppress the fuel bubbles from being sucked into the internal suction inlet.

In the fuel pump according to the present invention as set forth in the above definition, (3) the pump body preferably has a peripheral wall portion surrounding the circumference of the fuel storage chamber between the lower side wall portion and the upper side wall portion, and the insertion portion of the pressure pump mechanism is constructed to penetrate the peripheral wall portion. In this construction, the construction of the pump body thus defined can facilitate assembling of the pressure pump mechanism, and bore machining of the pump body (for example the internal suction inlet, the discharge opening and the like). Even more, it is possible not only to reduce unnecessary elements and parts to be thickened by carrying out the machining of bore passages in many directions to the constitutional elements and parts of the pump body, but also to form a suction gallery chamber having a relatively large volume even for the fuel pump of a small size.

In the fuel pump according to the present invention as set forth in the above definition (3), (4) at least one of the insertion portion of the pressure pump mechanism and the pump body is preferably provided with a guide portion to guide bubbles generated and rising at the lower side wall portion in the direction different from the direction in which the bubbles are moved toward the internal suction inlet. The above construction of the fuel pump according to the present invention can allow the guide portion to guide the fuel bubbles generated and rising in the fuel storage chamber out of the direction in which the fuel bubbles are moved toward the internal suction inlet, thereby making it possible to effectively suppress the fuel bubbles from being sucked into the fuel pressure chamber.

In the fuel pump according to the present invention as set forth in the above definition (4), (5) the guide portion preferably has a guide surface intersecting with at least the wall surface portion positioned in the vicinity of the internal suction inlet in the inner peripheral wall surface of the peripheral wall portion of the pump body. In this construction, the guide portion can guide the fuel bubbles generated on the lower side wall portion of the pump body in the direction away from the internal suction inlets with both of the guide surface and the inner peripheral wall surface of the peripheral wall portion used in combination, thereby making it possible to simplify the guide portion.

In the fuel pump according to the present invention as set forth in the above definition (4) or (5), (6) the guide portion may be constituted by a groove or a ridge provided at the insertion portion of the pressure pump mechanism. In this construction, the fuel bubbles rising along the outer peripheral surface of the insertion portion of the pressure pump mechanism can be guided in the extending direction of the groove or the ridge, thereby making it possible to effectively guide the fuel bubbles in the direction away from the internal suction inlet.

In the fuel pump according to the present invention as set forth in any one of the above definitions, (7) the insertion portion of the pressure pump mechanism preferably accommodates therein a suction valve to be opened to allow the suction of the fuel into the fuel pressure chamber, and is formed therein with a fuel discharge passage to discharge the fuel from the fuel pressure chamber to the outside. The fuel pump thus constructed can drastically reduce the machining of the bore passages to the pump body, thereby making it possible to facilitate the machining operation and to reduce the unnecessary portions of the pump body to be thickened.

In the fuel pump according to the present invention as set forth in any one of the above definitions (4) to (6), (8) the pump body is preferably mounted on the outer wall portion of an internal combustion engine, and the input portion is inputted with power from a driving member mounted on the internal combustion engine at the lower side wall portion of the pump body, the guide portion preferably has a plate-like member disposed between the lower side wall portion and the insertion portion of the pressure pump mechanism, and the inside of the fuel storage chamber is preferably divided into a bubble suppression area having the internal suction inlet disposed therein and a bubble accommodation area accommodating therein and disappearing fuel bubbles. The fuel pump thus constructed makes it possible to facilitate the machining of the main body of the pump body and to form an effective guide surface with the guide portion having the plate-like member being mounted on the main body of the pump body. In this construction, the fuel bubble accommodation portion is provided at any one or more of the guide portion, the pump body, and the insertion portion of the pressure pump mechanism, the fuel bubbles may be stored at a position spaced apart from the internal suction inlet within the fuel bubble accommodation area of the guide portion.

In the fuel pump according to the present invention as set forth in any one of the above definitions (3) to (8), (9) the insertion portion of the pressure pump mechanism preferably has the internal suction inlet at a position out of the inner peripheral surface of the peripheral wall portion in the radial direction of the peripheral wall portion of the pump body. In this construction, the internal suction inlet is positioned for example horizontally inwardly of the inner peripheral surface of the peripheral wall portion of the pump body, and the fuel bubbles are guided along the inner peripheral surface of the peripheral wall portion of the pump body, thereby making it possible to direct the fuel bubbles away from the internal suction inlet. The internal suction inlet is positioned horizontally outwardly of the inner peripheral surface of the peripheral wall portion, and the fuel bubbles are guided toward the central side of the peripheral wall portion than the internal suction inlet by the guide portion, thereby making it possible to direct the fuel bubbles away from the internal suction inlet.

A fuel supply system of an internal combustion engine according to the present invention is (10) provided with the fuel pump as set forth in any one of the above definitions (1) to (9), and comprises a feed pump that supplies fuel pumped up from a fuel tank to the fuel introduction passage of the fuel pump, and a delivery pipe that stores the fuel pressurized and discharged by the pressure pump mechanism and supplies the fuel to a fuel injection valve, the fuel storage chamber of the pump body having the fuel from the feed pump stored therein. The fuel supply system thus constructed can reliably prevent the lowering of the supply property of the pressurized fuel to the delivery pipe side by using the fuel pump which can effectively suppress fuel bubbles from being sucked into the fuel pressure chamber and achieve a stable fuel pressure property.

Advantageous Effects of Invention

According to the present invention, the internal suction inlet can easily be disposed out of the progression pathways of the fuel bubbles in the intermediate height area in which there is a small distribution amount of fuel bubbles. The present invention therefore can provide a fuel pump which can effectively suppress fuel bubbles from being sucked into the fuel pressure chamber and achieve a stable fuel pressure property.

The present invention can provide a fuel supply system of an internal combustion engine which can enhance the supply property of the pressurized fuel by using the above fuel pump.

DESCRIPTION OF EMBODIMENTS

The preferred embodiment of the present invention will be described hereinafter with reference to the accompanying drawings.

First Embodiment

FIGS. 1 to 8 show a construction of a fuel pump according to a first embodiment of the present invention and a fuel supply system provided with the fuel pump.

Figure 1:
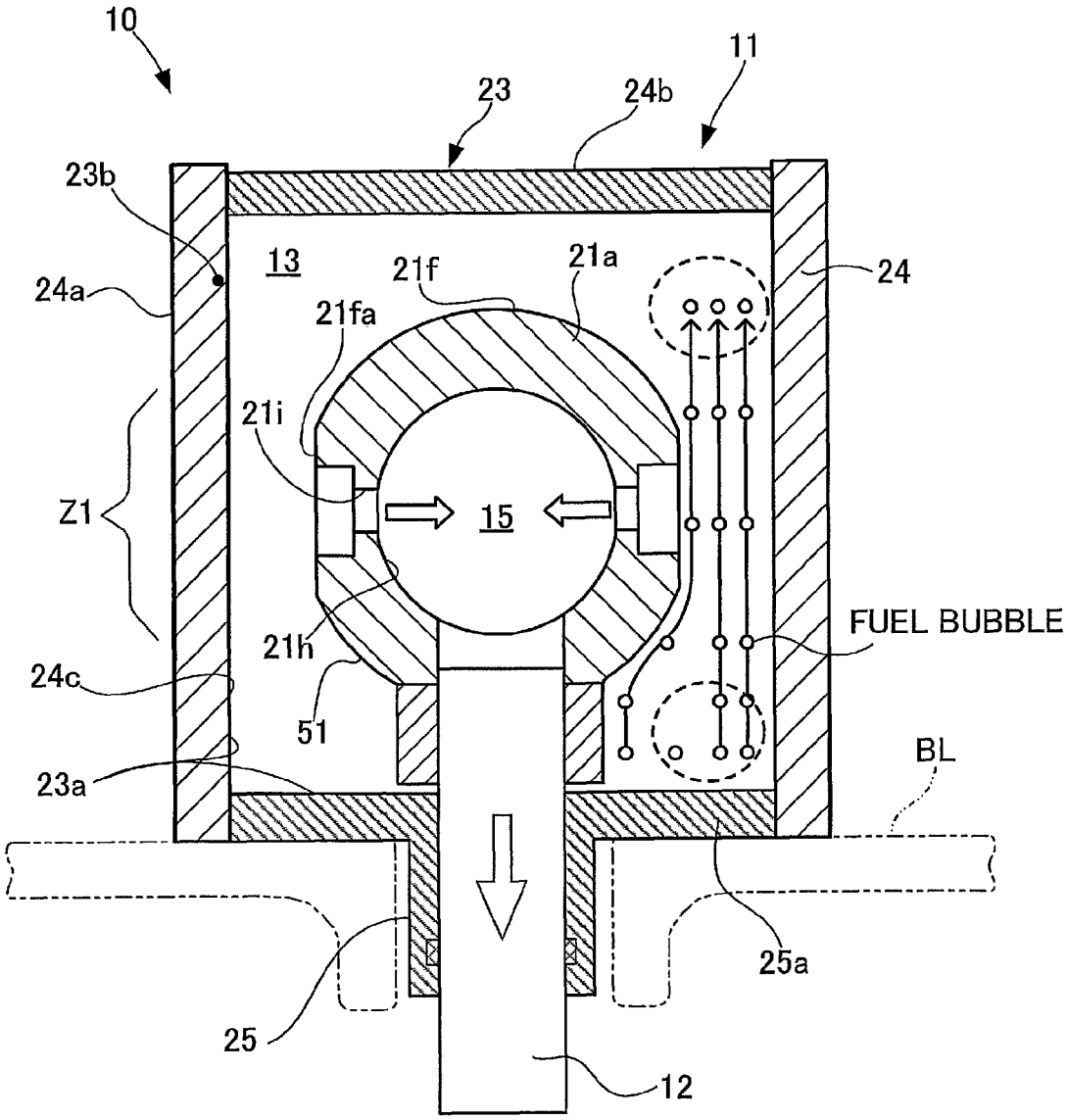
FIG. 1 is a cross-sectional view showing a schematic construction of a fuel pump according to a first embodiment of the present invention.
Figure 2:
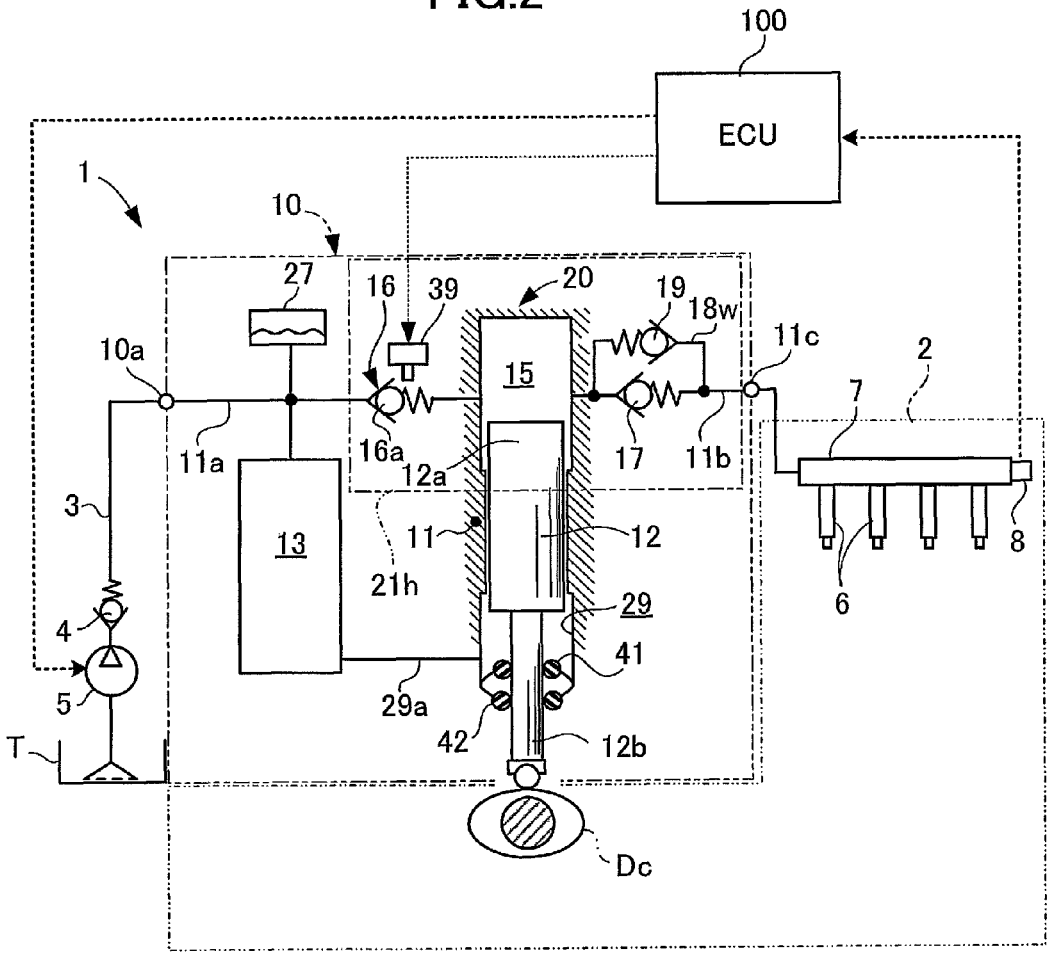
FIG. 2 is a schematic construction view of a fuel supply system of an internal combustion engine provided with the fuel pump according to the first embodiment of the present invention.
Figure 3:
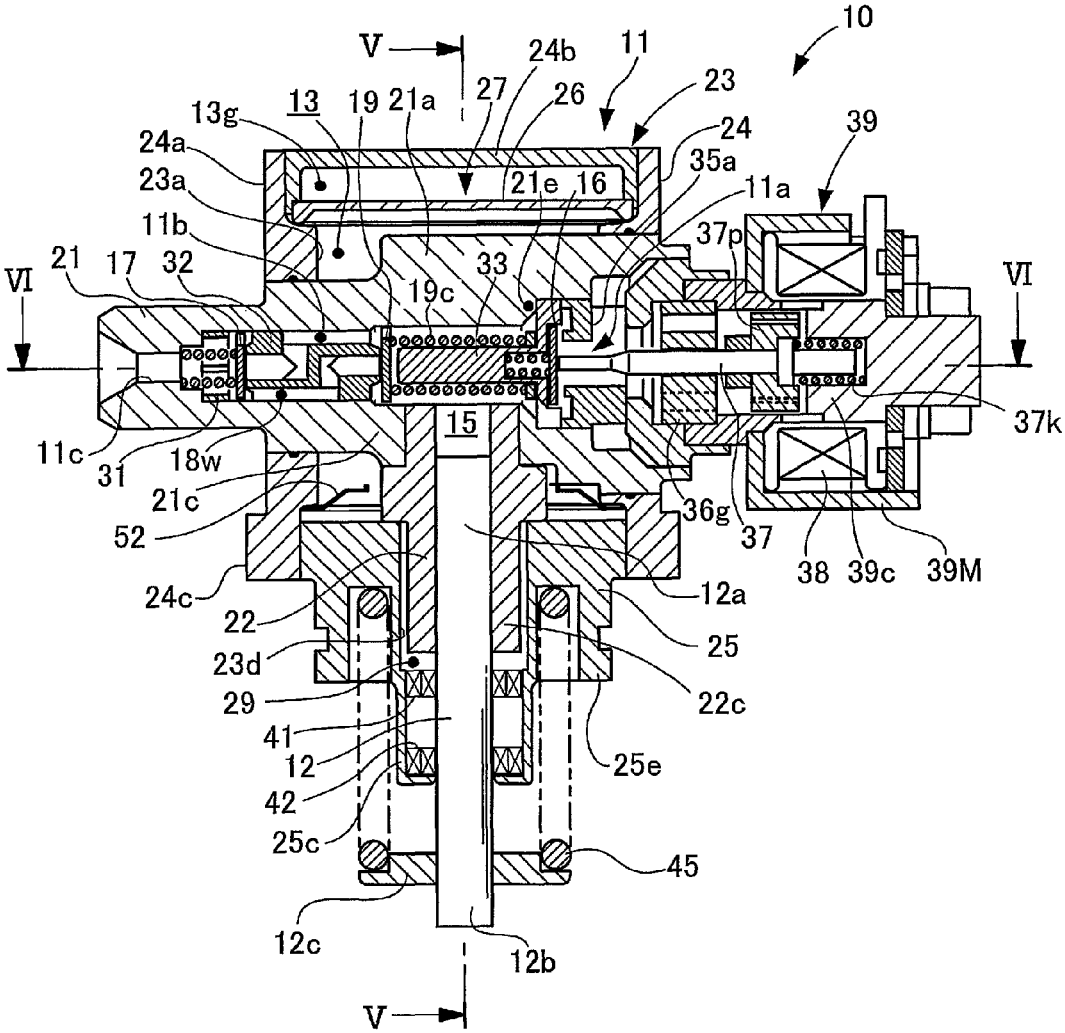
FIG. 3 is a front cross-sectional view of the fuel pump according to the first embodiment of the present invention.

As shown in FIGS. 2 and 3, the fuel pump according to the present embodiment is exemplified by a plunger pump type of the fuel pump 10 for use in producing high pressure. The fuel pump 10 is mounted on an internal combustion engine, for example, a V-type multi-cylinder gasoline engine of the dual injection (hereinafter, simply referred to as an engine), and is provided as part of a fuel supply system 1.

The fuel supply system 1 has a delivery pipe 7 provided to distribute fuel at a high pressure to a plurality of injectors (fuel injection valves) 6 that inject the fuel into cylinders. The high pressurized fuel to be accumulated and stored in the delivery pipe 7 is adapted to be supplied by the fuel pump 10.

The fuel pump 10 is connected through a pipe 3 and a check valve 4 with a feed pump 5 provided in a fuel tank T, so that the fuel pump 10 can be supplied with the fuel pressurized to a relatively low feed pressure. Here, the feed pump 5 is, for example, constructed by an electric motor-driven type of low pressurized fuel pump which can pump up gasoline, i.e., fuel in the fuel tank T. The fuel discharged from the feed pump 5 is adapted to be supplied to port injecting injectors not shown. The fuel pressure of the fuel discharged from the feed pump 5 is adapted to be adjusted by a pressure regulator also not shown.

As shown in FIGS. 1 to 6, the fuel pump 10 has a pump body 11 secured to the outer wall portion BL of an engine 2 (including a pump mounting case integrally secured to the outer wall portion), and a plunger 12 received in the pump body 11 to be axially reciprocatable with respect to the pump body 11. The pump body 11 is formed with a suction passage 11*a* (fuel introduction passage) allowing the fuel from the feed pump 5 to be introduced therein, and a discharge passage 11*b* allowing the fuel pressurized therein to be discharged toward the delivery pipe 7. The delivery pipe 7 functions to store and accumulate the high pressurized fuel pressurized and discharged by the fuel pump 10 to deliver and supply the high pressurized fuel to the injectors 6 when the injectors 6 respectively provided to the cylinders of the engine 2 (not shown by detailed figures) that inject the fuel into the cylinders are operated to be selectively opened.

The part of the suction passage 11*a* of the pump body 11 is formed by a suction gallery chamber 13 (fuel storage chamber) in the form of a roughly cylindrical column and capable of storing the fuel supplied from the feed pump 5. The suction gallery chamber 13 is held in communication with an auxiliary chamber 29 formed between the outer end portion 12*b* (lower one end portion in FIG. 1) of the plunger 12 and the pump body 11 by way of a communication passage 29*a*, so that the fuel can be allowed to move between the suction gallery chamber 13 and the auxiliary chamber 29 in response to the reciprocating displacement of the plunger 12. The pump body 11 has a fuel introduction pipe portion 11*p* projecting to the outside and having a forward end portion formed with a suction inlet 10*a* (see FIGS. 2 and 6). In the neighborhood of the suction inlet 10*a* is provided a fuel filter not shown in the drawings.

The plunger 12 has an inner end portion 12*a* (upper one end portion in FIG. 2) slidably received in the pump body 11. In the pump body 11 between the plunger 12 and the pump body 11 is formed a fuel pressure chamber 15 held in communication with the suction passage 11*a* and the discharge passage 11*b*. The fuel pressure chamber 15 has a volume variable (increased or decreased) in response to the displacement of the plunger 12 to enable the fuel to be selectively suctioned into the fuel pressure chamber 15 or discharged from the fuel pressure chamber 15.

The plunger 12 is engaged at the outer end portion 12*b* with a drive cam Dc (see FIG. 2) through a roller or a tappet and the like. The drive cam Dc is well known in the art and provided in a cylinder head (not shown by detailed figures) forming part of the engine 2 to actuate the plunger 12. The outer end portion 12*b* constitutes an input portion inputted with a power from the drive cam Dc as defined in the present invention.

Figure 5:
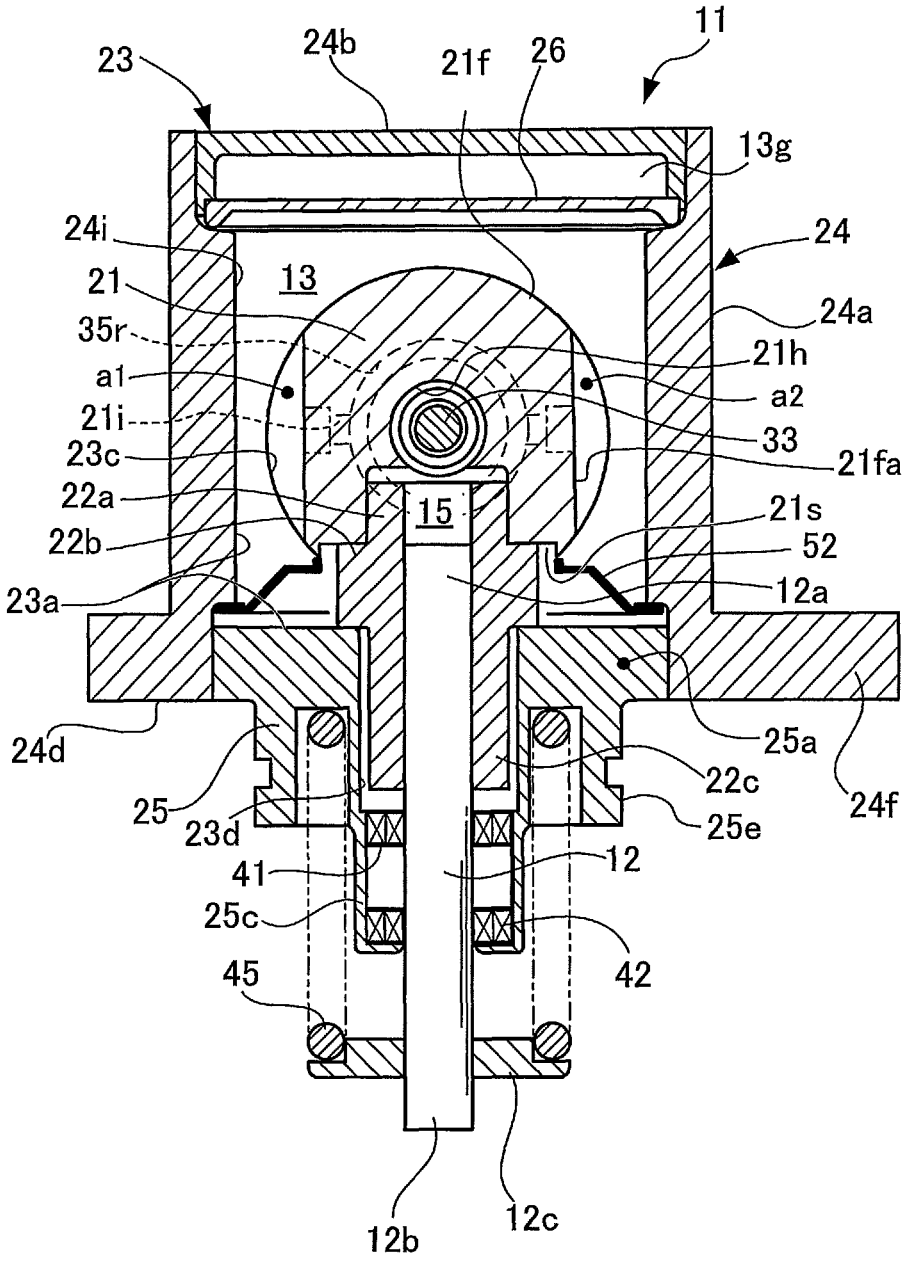
FIG. 5 is a cross-sectional view taken along the line V-V of FIG. 3.

As shown in FIGS. 3 and 5, in the vicinity of the outer end portion 12*b* of the plunger 12 is provided a spring receiving member 12*c*. Between the spring receiving member 12 and the pump body 11 is disposed a compression coil spring 45 which is held in the compressed state. This means that the plunger 12 is at all times urged by the compression coil spring 45 in the direction (downwardly in FIG. 3) having the volume of the fuel pressuring chamber 15 increased, so that when the drive cam Dc is driven to rotate by the power of the engine 2, the plunger 12 is adapted to be driven to reciprocate in response to the rotation of the drive cam Dc.

Forwardly and rearwardly of the fuel pressure chamber 15, viz., at the suction side and the discharge side of the fuel pressure chamber 15 are provided a suction valve 16 and a discharge valve 17 constituting a plurality of valve elements. The suction valve 16 is constituted by a check valve positioned at the downstream side of the suction gallery chamber 13 to allow the fuel to be suctioned to the fuel pressure chamber 15 but to check the fuel to flow in the opposite direction. The discharge valve 17 is also constituted by a check valve operative to allow the fuel to be discharged from the fuel pressure chamber 15 but to check the fuel to flow in the opposite direction.

When the plunger 12 is upwardly displaced in FIG. 3 to decrease the volume of the fuel pressuring chamber 15, the fuel in the fuel pressure chamber 15 is pressurized to have the pressure in the fuel pressure chamber 15 to be increased, so that the discharge valve 17 is opened under the state that the suction valve 16 is closed. When, on the other hand, the plunger 12 is downwardly displaced in FIG. 3 to increase the volume of the fuel pressuring chamber 15, the pressure of the fuel in the fuel pressure chamber 15 is lowered, so that the suction valve 16 is opened under the state that the discharge valve 17 is closed.

Figure 4:
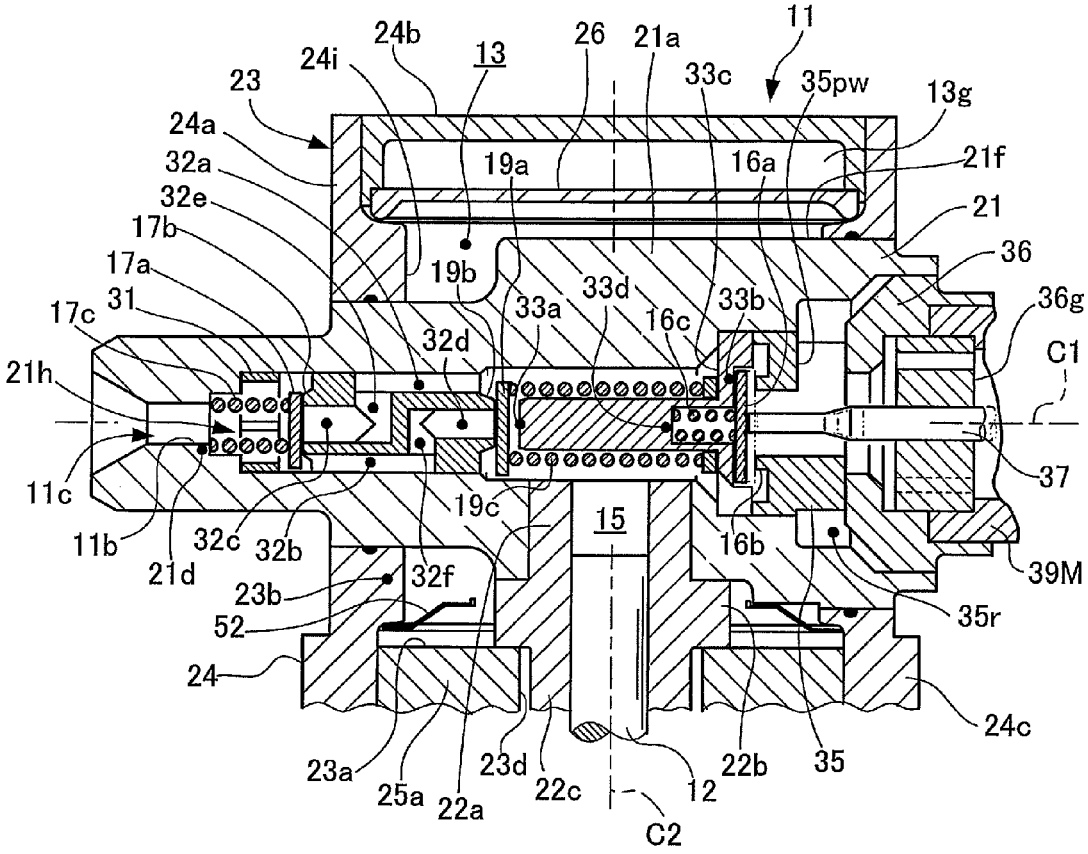
FIG. 4 is an enlarged cross-sectional view of an essential portion forming part of a pressure pump mechanism partly constituting the fuel pump according to the first embodiment of the present invention.

As shown in FIGS. 2 to 4, in the pump body 11 at the discharge side of the fuel pressure chamber 15 is formed a bypass passage 18*w* to bypass the discharge valve 17. On the bypass passage 18*w* is provided a relief valve 19 capable of selectively opening or closing the bypass passage 18*w*.

The relief valve 19 is adapted to be opened when something abnormal is caused in the system to have the pressure in the fuel pressure chamber 15 reach a low pressure at the time of having the fuel suctioned into the fuel pressure chamber 15 under the state that the pressure of the fuel in the discharge passage 11*b* at the downstream side of the discharge valve 17 is exceedingly increased with respect to the pressure of the fuel in the fuel pressure chamber 15 by the predetermined relief valve opening pressure (markedly increased as compared with the predetermined accumulation pressure level of the delivery pipe 7).

As shown in FIGS. 2 to 4, the suction valve 16 is constituted by a valve body 16*a* in the form of a plate to selectively open or close the suction passage 11*a*, an annular valve seat 16*b*, and a preload spring 16*c* (resilient member) that retains the closed state in which the valve body 16*a* is in contact with the valve seat 16*b* until the suction pressure exerted on the suction valve 16 reaches a predetermined suction pressure (pressure lower than the feed pressure by the predetermined suction valve opening pressure difference).

On the other hand, the discharge valve 17 is constituted by a valve body 17*a* in the form of a plate to selectively open or close the discharge passage 11*b*, an annular valve seat 17*b*, and a preload spring 17*c* (resilient member) that retains the closed state in which the valve body 17*a* is in contact with the valve seat 17*b* until the discharge pressure exerted on the discharge valve 17 reaches a predetermined discharge pressure (pressure higher than the pressure of the fuel in the delivery pipe by the predetermined discharge valve opening pressure difference).

Further, the relief valve 19 is constituted by a valve body 19*a* in the form of a plate to selectively open or close the bypass passage 18*w*, an annular valve seat 19*b*, and a preload spring 19*c* (resilient member) that retains the closed state in which the valve body 19*a* is in contact with the valve seat 19*b* until the discharge pressure of the fuel in the discharge passage 11*b* is exceedingly increased or the pressure of the fuel in the fuel pressure chamber 15 is further decreased to have the forward and rearward pressure difference of the valve body 19*a* in the form of a plate reach a predetermined relief valve opening pressure difference. The valve bodies 17*a*, 19*a* each in the form of a plate is for example roughly formed in a disc shape having one or more cutouts on the peripheral portions of the valve bodies 17*a*, 19*a*, respectively to serve as passages allowing the fuel to pass therethrough.

The previously mentioned pump body 11, the plunger 12, the fuel pressure chamber 15, the suction valve 16, the discharge valve 17, and the drive cam Dc constitute as a whole a pressure pump mechanism 20 as defined in the present invention.

The pressure pump mechanism 20 has the fuel pressure chamber 15 formed between the suction passage 11*a* and the discharge passage 11*b* in the pump body 11 to enable the fuel in the fuel pressure chamber 15 to be pressurized therein and discharged therefrom in response to the reciprocation motions of the plunger 12. The pressure pump mechanism 20 is lubricated by engine oil (oil from the outside) in the cylinder head of the engine 2, and has an input portion constituted by the outer end portion 12*b* of the plunger 12 driven by the drive cam Dc. The drive cam Dc is for example integrally connected with one end portion of an exhaust cam shaft (not shown by detailed figures) forming part of the engine 2. The installation embodiment of the drive cam in itself is the same as that shown for example in the Patent Document 1.

The pump body 11 is constituted to include a valve retaining member 21 in the form of a cylinder, a cylinder member 22 supported on the cylindrical valve retaining member 21 to axially slidably retain the plunger 12, and an outer shell member 23 having an inner wall portion 23*b* forming the suction gallery chamber 13 therein. The valve retaining member 21, the cylinder member 22, and the outer shell member 23 have approximately axially symmetric shape so that longitudinal cross-sections are in symmetrical relationship with respect to their respective center axes at least at respective inner wall surface side thereof. This means that the valve retaining member 21, the cylinder member 22, and the outer shell member 23 are each in the form of a so-called cylindrical shape or a shape close to a cylinder.

The valve retaining member 21 and the cylinder member 22 have respective insertion portions 21*a*, 22*a* received in the outer shell member 23 in perpendicular relationship with each other. At least the valve retaining member 21 is constructed to penetrate in and through the inner wall surfaces 23*a* of the outer shell member 23. The outer shell member 23, the insertion portion 21*a* of the valve retaining member 21 inserted into an inner space in the form of a roughly cylindrical column of the outer shell member, and a flange portion 22*b* forming part of the cylinder member 22 define as a whole a suction gallery chamber 13. The insertion portion 22*a* of the cylinder member 22 is coupled with the insertion portion 21*a* of the valve retaining member 21 in the outer shell member 23, so that the respective insertion portions 21*a*, 22*a* of the valve retaining member 21 and the cylinder member 22, and the plunger 12 collectively form a fuel pressuring chamber 15 in a valve accommodating bore 21*h*.

The valve retaining member 21 is formed in a cylindrical shape and has a stepped valve accommodating bore 21*h* and a stepped outer peripheral surface 21*f*. The stepped valve accommodating bore 21*h* and the stepped outer peripheral surface 21*f* axially extend in the central portion of the valve retaining member 21, and each of the valve accommodating bore 21*h* and the outer peripheral surface 21*f* is circular in cross-section and in a stepped form having increased diameters step by step toward the right end side in FIGS. 4 and 6. The valve retaining member 21 accommodates therein the suction valve 16, the discharge valve 17 and the relief valve 19 in the valve accommodating bore 21*h* forming a pump operation chamber. The suction valve 16, the discharge valve 17 and the relief valve 19 are retained by the valve retaining member 21 in a series arrangement state, viz., in axial alignment with one another. The valve retaining member 21 has a left end portion in FIG. 4 formed with a downstream end exit 11*c* forming part of the discharge passage 11*b*. The downstream end exit 11*c* of the discharge passage 11*b* is positioned at the most downstream side of the stepped valve accommodation bore 21*h*.

As shown in FIGS. 3 to 5, the cylinder member 22 is supported at its inner end side by the valve retaining member 21. The cylinder member 22 has an insertion portion 22*a* inserted in the axially intermediate portion of the cylindrical valve retaining member 21, a flange portion 22*b* adjacent to the insertion portion 22*a* and expanded in diameter, and a cylindrical portion 22*c* slidably accommodating the forward end portion of the plunger 12.

The outer shell member 23 is constituted by a cup-shaped member 24 and an oil seal holder 25. The cup-shaped member 24 has a cylindrical portion 24*a* in a roughly cylindrical shape having one end portion blocked by a lid portion 24*b* in a roughly disc shape. The oil seal holder 25 is held in pressing contact with the cylinder member 22, and secured to the cup-shaped member 24 to block the opening end portion 24*c* of the cup-shaped member 24. The oil seal holder 25 is formed therein with a central bore axially extending.

As shown in FIGS. 3 to 6, the valve accommodating bore 21*h* of the valve retaining member 21 accommodates therein the first to third valve stoppers 31, 32, and 33 in addition to the suction valve 16, the discharge valve 17, and the relief valve 19.

The first valve stopper 31 is constituted by an annular body having slits and snugly fitted in the innermost portion, viz., in the smallest diameter portion of the valve accommodating bore 21*h* of the valve retaining member 21 to regulate the maximum displacement in the opening direction of the valve body 17*a* of the discharge valve 17. The second valve stopper 32 is constituted by a passage forming member having two flexion passages forming part of the discharge passage 11*b* and the bypass passage 18*w*. More specifically, the second valve stopper 32 is formed with a pair of vertical grooves 32*a*, 32*b*, a pair of vertical bores 32*c*, 32*d*, and a pair of horizontal bores (radial bores) 32*e*, 32*f*. The vertical grooves 32*a*, 32*b* extend around the outer peripheral side of the second valve stopper 32. The vertical bores 32*c*, 32*d* are open at the central portion of the axial both ends of the second valve stopper 32, and to have a predetermined depth. The horizontal bores 32*e*, 32*f* have the vertical grooves 32*a*, 32*b* held in communication with the vertical bores 32*c*, 32*d*.

The valve stopper 32 has one end portion at which the valve seat 17*b* of the discharge valve 17 extends axially and annularly, and the other end portion at which the valve seat 19*b* of the relief valve 19 also extends axially and annularly. The valve body 17*a* of the discharge valve 17 and the valve body 19*a* of the relief valve 19 are respectively held in face-to-face relationship with the valve seats 17*b*, 19*b* formed at the both axial end portions of the second valve stopper 32. Between the stepped portion 21*d* (see FIG. 4) of the valve retaining member 21 in the innermost side of the valve accommodating bore 21*h* and the valve body 17*a* of the discharge valve 17 is disposed a preload spring 17*c* forming part of the discharge valve 17 and having a preload corresponding to a discharge valve opening difference pressure set in advance.

The third valve stopper 33 has stopper portions 33*a*, 33*b* and spring receiving portions 33*c*, 33*d* respectively corresponding to the relieve valve 19 and the suction valve 16. The stopper portions 33*a*, 33*b* and the spring receiving portions 33*c*, 33*d* are arranged in the opposite direction to the different radial positions from one another and integrally formed to become a roughly T-shaped cross-section member. The third valve stopper 33 serves as stopper functions to regulate the movable ranges of the valve bodies 16*a*, 19*a* and as spring receiving functions. Between the valve body 19*a* of the relief valve 19 and the spring receiving portion 33*c* of the third valve stopper 33 is disposed a preload spring 19*c* forming part of the relief valve 19 and having a preload corresponding to a relief valve opening difference pressure set in advance. Similarly, between the valve body 16*a* of the suction valve 16 and the spring receiving portion 33*d* of the third valve stopper 33 is disposed a preload spring 16*c* forming part of the suction valve 16 and having a preload corresponding to a suction valve opening difference pressure set in advance.

The third valve stopper 33 is held in face-to-face relationship with a passage forming member 35 at the outer peripheral portion of the spring receiving portion 33*c* shown in the right side of FIG. 4. The passage forming member 35 constitutes an annular valve seat 16*b* forming part of the suction valve 16. The outer peripheral portion of the spring receiving portion 33*c* is partly cut off to have a notch allowing the fuel pressure chamber 15 to be communicated to the portion in the vicinity of the valve seat 16*b* of the suction valve 16. The passage forming member 35 is accommodated in the valve accommodating bore 21*h* of the valve retaining member 21, and partly forms a communication passage 35*pw* extending from the suction gallery chamber 13 to the fuel pressure chamber 15 in the valve retaining member 21. The communication passage 35*pw* forms part of the suction passage 11*a*. The valve seat 16*b* of the suction valve 16 is formed by one end portion of the passage forming member 35 to surround the downstream end of the communication passage 35*pw* and to protrude axially and annularly toward the fuel pressure chamber 15.

The passage forming member 35 is retained in the state that the passage forming member 35 is pressurized to a stepped portion 21*e* formed on the valve retaining member 21 together with the stopper portion 33*b* of the third valve stopper 33 by a plug member 36 (see FIG. 3). The plug member 36 is for example screwed and secured to the right end inner peripheral portion in FIG. 3 of the valve retaining member 21. Among the passage forming member 35, the plug member 36 and the portion adjacent to the stepped portion 21*e* of the valve retaining member 21 is formed an annular communication passage 35*r* held in communication with the suction gallery chamber 13 at a plurality of positions. The annular communication passage 35*r* forms part of the communication passage 35*pw*. This means that the communication passage 35*pw* has one portion close to the valve seat 16*b* of the suction valve 16, and the other portion close to the suction gallery chamber 13. The portion close to the valve seat 16*b* of the suction valve 16 axially extends at the central portion of the valve retaining member 21 to be open at the inner side of the valve seat 16*b*, while the other portion close to the suction gallery chamber 13 extends radially and circumferentially of the passage forming member 35 to be open on the outer peripheral surface 21*f* of the valve retaining member 21 in the intermediate height area Z1 of the suction gallery chamber 13.

More specifically, the communication passage 35*pw* has, as shown in FIGS. 3 to 6, an end portion close to the suction gallery chamber 13 and is open at a pair of parallel cut surfaces 21*fa* partly forming the outer peripheral face 21*f* of the valve retaining member 21 (see FIGS. 5 and 6), so that the communication passage 35*pw* is partly formed by a pair of internal suction inlets 21*i*.

The pair of internal suction inlets 21*i* are positioned among and spaced apart from the upper surface side portion 25*a* of the oil seal holder 25, the lower end portion (lower side wall portion; hereinafter simply referred to as the upper side portion 25*a* of the oil seal holder 25) of the cylindrical portion 24*a* of the cup-shaped member 24 adjacent to the upper surface side portion 25*a* of the oil seal holder 25, the lid portion 24*b*, and the resilient film member 26 (upper side wall portion). The upper side portion 25*a* of the oil seal holder 25 is positioned at the vertically lower portion side of the inner wall portion 23*b* (at the lower side from the vertically central height of the inner wall portion 23*b*) of the outer shell member 23 partly forming the suction gallery chamber 13. The lid portion 24*b* and the resilient film member 26 are positioned at the vertically upper portion side (at the upper side from the vertically central height of the inner wall portion 23*b*) of the inner wall portion 23*b* of the outer shell member 23 partly forming the suction gallery chamber 13. The pair of parallel cut surfaces 21*fa* are in parallel relationship with the axis line of the cylindrical portion 24*a* (peripheral wall portion) of the cup-shaped member 24 surrounding the circumference of the suction gallery chamber 13 among the upper surface side portion 25*a* of the oil seal holder 25, the lid portion 24*b*, and the resilient film member 26. Here, the upper side portion 25*a* of the oil seal holder 25 becomes a heat receiving portion to receive heat from the engine E side (the outside). The heat is generated through the heat conducted from the outer wall portion BL of the engine 2, the heat conducted from the outer end portion 12*b* of the plunger 12, and the heat conducted from the lubricating and cooling oil in the engine 2, etc. The heat at the outer end portion 12*b* of the plunger 12 is generated with the input to the plunger 12 from the drive cam Dc. The lubricating and cooling oil comes to be at an extremely high temperature as compared with the fuel temperature. The upper side portion 25*a* of the oil seal holder 25 can be higher in temperature than the other parts of the pump body 11 such as for example the lid portion 24*b* and the resilient film member 26 when the upper side portion 25*a* of the oil seal holder 25 receives the heat from the outside.

Figure 6:
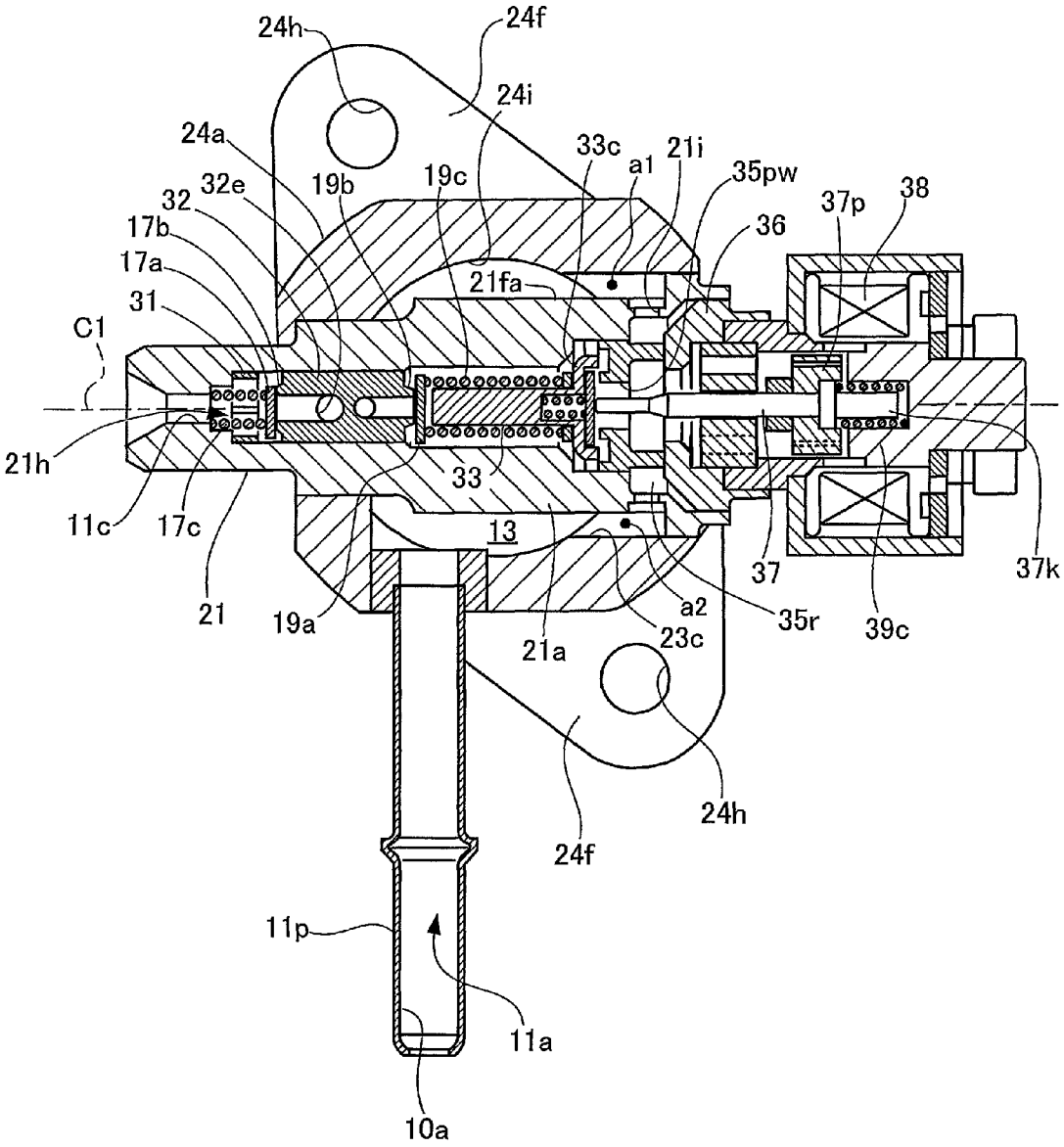
FIG. 6 is a cross-sectional view taken along the line VI-VI of FIG. 3.

Each of the internal suction inlets 21*i* is spaced apart at the predetermined distances from at least any parts of the inner wall surfaces 23*a* of the outer shell member 23. The insertion portion 21*a* of the valve retaining member 21 has the internal suction inlets 21*i* at the positions away from the inner peripheral surface 24*i* of the cylindrical portion 24*a* in the radial direction of the cylindrical portion 24*a* of the cup-shaped member 24 forming the peripheral wall portion of the outer shell member 23. More specifically, as shown in FIGS. 5 and 6, the valve retaining member 21 and the outer shell member 23 are formed with a pair of intermediate passages a1, a2 extending radially outwardly from the inner peripheral surface 24*i* of the cylindrical portion 24*a* and having the suction gallery chamber 13 held in communication with the pair of internal suction inlets 21*i* between the pair of parallel cut surfaces 21*fa* of the insertion portion 21*a* of the valve retaining member 21 and an insertion bore wall surface 23*c* formed on the outer shell member 23. The pair of intermediate passages a1, a2 has passage cross-sectional areas larger than the opening areas of the pair of internal suction inlets 21*i* and equal to or larger than the opening area of the suction inlet opening 10*a*.

The pressure pump mechanism 20 has the insertion portion 21*a* of the valve retaining member 21 among the upper side portion 25*a* of the oil seal holder 25 at the vertically lower portion side of the inner wall portion 23*b* of the outer shell member 23, the lid portion 24*b* of the cup-shaped member 24 and the resilient film member 26 at the vertically upper portion side of the inner wall portion 23*b* of the outer shell member 23. The insertion portion 21*a* of the valve retaining member 21 is formed with the internal suction inlets 21*i* positioned in the vertically intermediate height area Z1 (see FIG. 1) in the suction gallery chamber 13 to allow the fuel to be sucked into the valve accommodation bore 21*h* of the valve retaining member 21 from the suction gallery chamber 13.

On the other hand, at least one of the insertion portions 21*a*, 22*a* of the valve retaining member 21 and the cylinder member 22, and the outer shell member 23 is formed with a guide portion 50 to guide fuel vapor (fuel bubbles), generated and rising at the high temperature lower side wall portion of the inner wall portion 23*b* of the outer shell, for example, at the upper surface side portion 25*a* of the oil seal holder 25, in the direction different from the direction in which the fuel bubbles are moved toward the internal suction inlets 21*i*.

The guide portion 50 has a bubble guiding surface 51 extending roughly horizontally but not vertically between at least one of the internal suction inlets 21*i* and the upper surface side portion 25*a* of the oil seal holder 25, so that the bubble guiding surface 51 of the guide portion 50 can direct the fuel bubbles rising by buoyancy in the suction gallery chamber 13 after being generated at the upper surface side portion 25*a* of the oil seal holder 25 to be away from the internal suction inlets 21*i*. This means that the guide portion 50 is constructed to guide the fuel bubbles to within a specified range so as to restrict the progression pathways of the fuel bubbles rising by buoyancy at least within the specified range in the intermediate height area Z1 of the suction gallery chamber 13.

The bubble guiding surface 51 of the guide portion 50 is formed on at least one of the insertion portions 21*a*, 22*a* of the valve retaining member 21 and the cylinder member 22, and the outer shell member 23, or otherwise formed on a bubble guiding member (hereinafter described), viz., one separate element assembled with at least one of the insertion portions 21*a*, 22*a* of the valve retaining member 21 and the cylinder member 22, and the outer shell member 23. The bubble guiding surface 51 of the guide portion 50 is positioned to intersect at least the wall surface portion positioned in the vicinity of the internal suction inlets 21*i* in the inner peripheral surface 24*i* of the cylindrical portion 24*a* of the cup-shaped member 24.

Figure 7A:
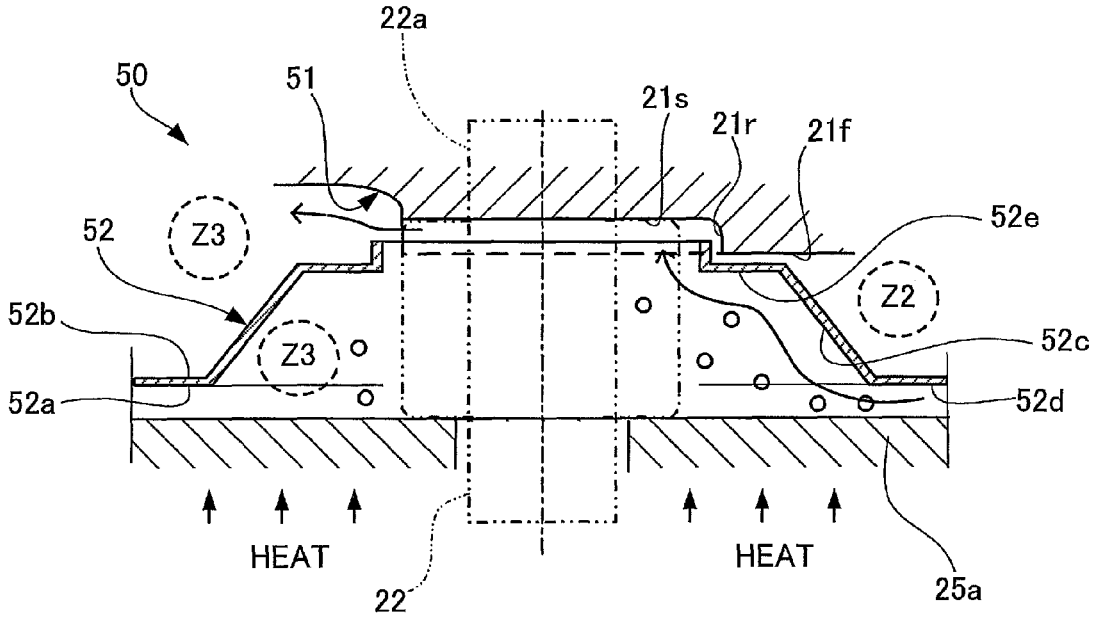
FIG. 7A is a partially enlarged cross-sectional view of a portion in the vicinity of a guide portion in the fuel pump according to the first embodiment of the present invention.

More specifically, the stepped outer peripheral surface 21*f* of the valve retaining member 21 increased in diameter toward the right side in FIG. 4 has a vertically lower portion of the axially intermediate portion 21*c* of the valve retaining member 21, the vertically lower portion being positioned vertically upwardly toward the left side as shown in FIG. 7A. Further, the axially intermediate portion 21*c* of the valve retaining member 21 has a portion close to the flange portion 22*b* adjacent to the insertion portion 22*a* of the cylinder member 22, the portion being subject to a counterbore processing work to be formed into a groove-like concave section 21*s*. The concave section 21*s* is formed with a side wall surface 21*r* formed in a roughly U-shape and closed at the side of the internal suction inlets 21*i* in the axial direction of the valve retaining member 21 and opened at the side opposite to the internal suction inlets 21*i* in the axial direction of the valve retaining member 21.

The guide portion 50 has a partition plate 52 (plate-like member) serving as a bubble guiding member disposed between the upper surface side portion 25*a* of the oil seal holder 25 and the insertion portions 21*a*, 22*a* of the pressure pump mechanism 20.

The partition plate 52 is disposed at the lower side of the inside portion of the suction gallery chamber 13 and at the periphery of the cylinder member 22, and has a vertically lower surface 52*a* facing the upper side surface portion 25*a* of the oil seal holder 25, and a vertically upper side surface 52*b* facing the insertion portion 22*a* of the cylinder member 22. The lower surface 52*a* of the partition plate 52 is constituted by an inclined guide surface portion 52*c* bent and inclined in the form of a truncated cone outer peripheral surface, a lower side guide surface portion 52*d* connected with the lower end of the inclined guide surface portion 52*c* and extending radially outwardly, and an upper guide surface portion 52*e* extending from the upper end of the inclined guide surface portion 52*c* toward the inside of the concave section 21*s* of the valve retaining member 21.

The lower surface 52*a* of the partition plate 52 is disposed to have the fuel bubbles collide with one another at the positions spaced apart from the internal suction inlets 21*i* when the fuel bubbles generated on the side of the upper surface side portion 25*a* of the oil seal holder 25 to be heated to a high temperature are elevated by buoyancy. The progression pathways of the fuel bubbles are restricted to the left upper side in FIG. 7A, viz., in the direction away from the internal suction inlets 21*i* while passing through the inside of the concave section 21*s*. Here, the direction away from the internal suction inlets 21*i* indicates the upper portion of the axially one side of the valve retaining member 21.

The partition plate 52 is constructed to divide the inside portion of the suction gallery chamber 13 into the bubble suppression area Z2 in which the fuel bubbles from the upper surface side portion 25*a* of the oil seal holder 25 are suppressed from entering the bubble suppression area Z2, and the bubble accommodation area Z3 in which the fuel bubbles are accommodated and naturally vanished at the time when the state of the fuel bubbles is changed. The internal suction inlets 21*i* formed in the insertion portion 21*a* of the valve retaining member 21 are disposed within the range of the bubble suppression area Z2.

The lower surface 52*a* of the partition plate 52 and the groove-like concave section 21*s* of the valve retaining member 21 constitutes as a whole a bubble guiding surface 51 of the guide portion 50. The bubble guiding surface 51 thus constructed can restrict the fuel bubbles rising by buoyancy from the upper surface side portion 25*a* of the oil seal holder 25 to the progression pathways of the fuel bubbles away from the internal suction inlets 21*i*, thereby making it possible to suppress the fuel bubbles from being sucked into the internal suction inlets 21*i*.

Figure 7B:
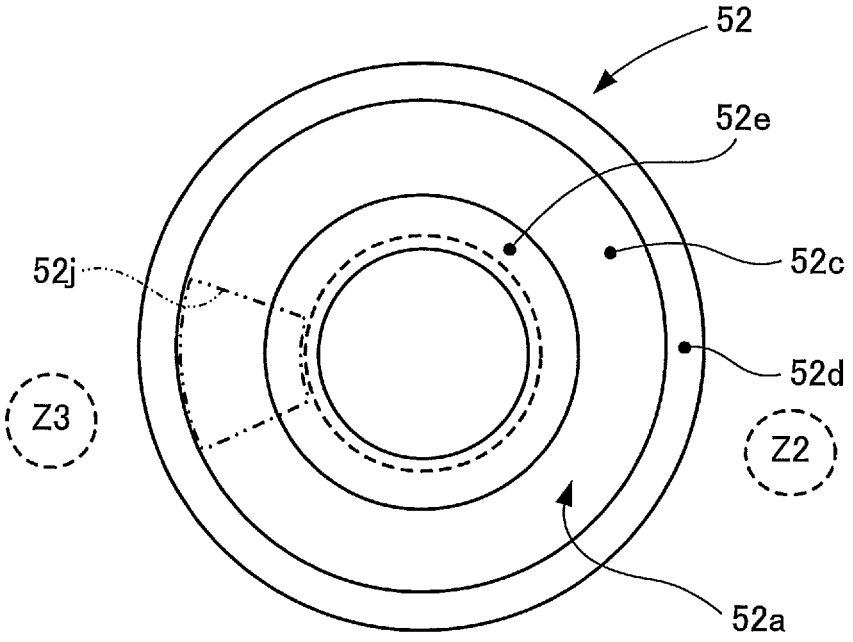
FIG. 7B is a lower surface view of a partition plate forming part of the guide portion in the fuel pump according to the first embodiment of the present invention.

The partition plate 52 of the guide portion 50 in the present embodiment is constituted by an annular member as shown for example in solid lines in a plan view of FIG. 7B, however, part of the partition plate 52 in the bubble accommodation area Z3 may be formed with a cutout portion 52*j* as shown in phantom lines in FIG. 7B according to the present invention. The partition plate 52 may be formed in a horseshoe shape, a roughly U-shape, or an arcuate shape with a portion cut out at the side of the bubble accommodation area Z3 to be opened at the side opposite to the internal suction inlets 21*i* and closed at the side of the internal suction inlets 21*i* in the axial direction of the valve retaining member 21. It may be considered that the lower surface 52*a* of the partition plate 52 is formed by the lower surface portion of the axially intermediate portion 21*c* of the valve retaining member 21, or formed by a part of the outer shell member 23 projecting into the suction gallery chamber 13 at the lower side of the axially intermediate portion 21*c* of the valve retaining member 21. It may further be considered that the partition plate 52 is replaced by a wire member or a band-shape member capable of guiding the fuel bubbles in the direction away from the internal suction inlets 21*i*.

The cup-shaped member 24 is integrally formed with a flange portion 24*f* having a mounting criteria surface 24*d* and mounting holes 24*h* formed therein. The oil seal holder 25 has an oil seal retaining portion 25*c*, and a boss portion 25*e*. The oil seal retaining portion 25*c* is adapted to retain a plurality of oil seals 41, 42 held in engagement with the plunger 12. The boss portion 25*e* is in the form of a roughly cylindrical shape and in coaxial relationship with the plunger 12 surrounding one end portion of the compression coil spring 45. The oil seals 41, 42 function as seal members to seal the auxiliary chamber 29 between the oil seal holder 25 and the plunger 12, the auxiliary chamber 29 being communicated with a gap for sliding formed between the plunger 12 and the cylinder portion 22.

The lower surface side portion 25*b* of the oil seal holder 25, and the elements and parts in the vicinity of the outer end portion 12*b* of the plunger 12 are exposed to the lubricating oil scattering in the cylinder head of the engine 2.

The elements and parts in the valve retaining member 21 and the cylinder member 22 constituting the pump body 11, and the cup-shaped member 24 and the oil seal holder 25 of the outer shell member 23 which are subject to high pressure are each made of a metal material such as for example stainless steel and other stainless steel (for example carbon steel and special steel) having a high strength. On the other hand, the elements and parts in the valve retaining member 21 and the cylinder member 22 constituting the pump body 11, and the cup-shaped member 24 and the oil seal holder 25 of the outer shell member 23 which are subject to low pressure (not subject to high pressure) are each made of a metal material similarly to the high pressure elements and parts as previously mentioned or other metal materials having a rigidity lower than those of the above materials. Each of the valve retaining member 21, the cylinder member 22, the cup-shaped member 24, and the oil seal holder 25 has a fitting portion fitted with or slidable with other members, a mounting surface, and the like produced by a mechanical working.

The outer shell member 23 is attached with a resilient film member 26 with a predetermined gap 13*g* to and adjacent to the lid portion 24*b* in such a manner that the resilient film member 26 is subject to the pressure of the fuel stored in the suction gallery chamber 13. The resilient membrane member 26 is adapted to impart resiliency to part of the inner wall of the suction gallery chamber 13, and thus constitutes a pulsation damper 27, so that the pulsation of the fuel pressure in the suction passage 11*a* can be absorbed.

The valve body 16*a* of the suction valve 16 is operative to be opened or closed by the operation member 37. The operation member 37 is slidably supported on a guide portion 36*g* forming part of the plug member 36. The operation member 37 is operated to impart a pressing operation force to the valve body 16*a* of the suction valve 16 in a direction having the valve body 16*a* opened (leftward in FIG. 4) against the urging force of a preload spring 16*c* that urges the valve body 16*a* to be closed, thereby making it possible to open the suction valve 16.

The operation member 37 constitutes part of an operating plunger received in an electromagnetic coil 38 occupying the right end side in FIG. 3, so that the operation member 37 can be sucked by the electromagnetic coil 38 when the electromagnetic coil 38 is energized and excited. This means that the valve body 16*a* of the suction valve 16 is returned to the valve closing direction by the urging force of the preload spring 16*c* when the electromagnetic coil 38 is energized and excited (ON state). The operation member 37 and the electromagnetic coil 38 constitute as a whole an electromagnetic operation unit 39. The electromagnetic operation unit 39 is adapted to control a time period in which the suction valve 16 is forcibly opened, thereby making it possible to variably control a pressure time period of the fuel pressurized in the fuel pressure chamber 15 by the plunger 12.

More specifically, the base end portion of the operation member 37 has a movable core 37*p* mounted thereon to be close to the inner diameter of the electromagnetic coil 38. The electromagnetic coil 38 has a main body 39M forming part of the electromagnetic operation unit 39 and accommodating therein the electromagnetic coil 38, and at the side of the main body 39M is provided a stator core 39*c* facing the movable core 37*p*. Between the base end portion of the operation member 37 and the stator core 39*c* is provided a compression coil spring 37*k* (resilient member) in compressed state serving to urge the operation member 37 in the direction in which the suction valve 16 is opened. The assembled preload of the compression coil spring 37*k* is adapted to generate an urging force added to the urging force acting the valve body 16*a* in the direction in which the valve body 16*a* is opened in accordance with the difference pressure acting on front side and rear side of the valve body 16*a* of the suction valve 16, and is set to be able to open the suction valve 16 against the urging force of the preload spring 16*c* that urges the valve body 16*a* in the direction in which the valve body 16*a* is closed.

The electromagnetic operation unit 39 is constructed to be energized and controlled by an ECU 100 when the engine 2 is operated to generate the power by which the drive cam Dc of the fuel pump 10 is driven to operate the plunger 12 with a lift amount periodically changed. More specifically, the ECU 100 is adapted to repeatedly determine in a predetermined period whether or not the actual fuel pressure in the delivery pipe 7 reaches a preliminarily set delivery pressure in accordance with the detection information of a fuel pressure sensor 8 provided on the delivery pipe 7. When the actual fuel pressure in the delivery pipe 7 is decreased below a predetermined pressure value close to the preliminarily set delivery pressure after the fuel injection from the injector 6 is executed, the ECU 100 is adapted to energize an electromagnet coil 38 forming part of the electromagnetic operation unit 39 in the period (a predetermined crank angle period in which the fuel can be pressurized) in which the lift amount of the plunger 12 is increased, so that the high pressurized fuel is supplied into the delivery, pipe 7 from the fuel pressure chamber 15. While the electromagnet coil 38 of the electromagnetic operation unit 39 is being energized, the operation member 37 is sucked by the electromagnet coil 38 against the urging force of the compression coil spring 37*k* acting in the direction in which the suction valve 16 is opened, thereby removing a pressing load that opens the suction valve 16 to perform the closing operation of the suction valve 16.

Figure 8:
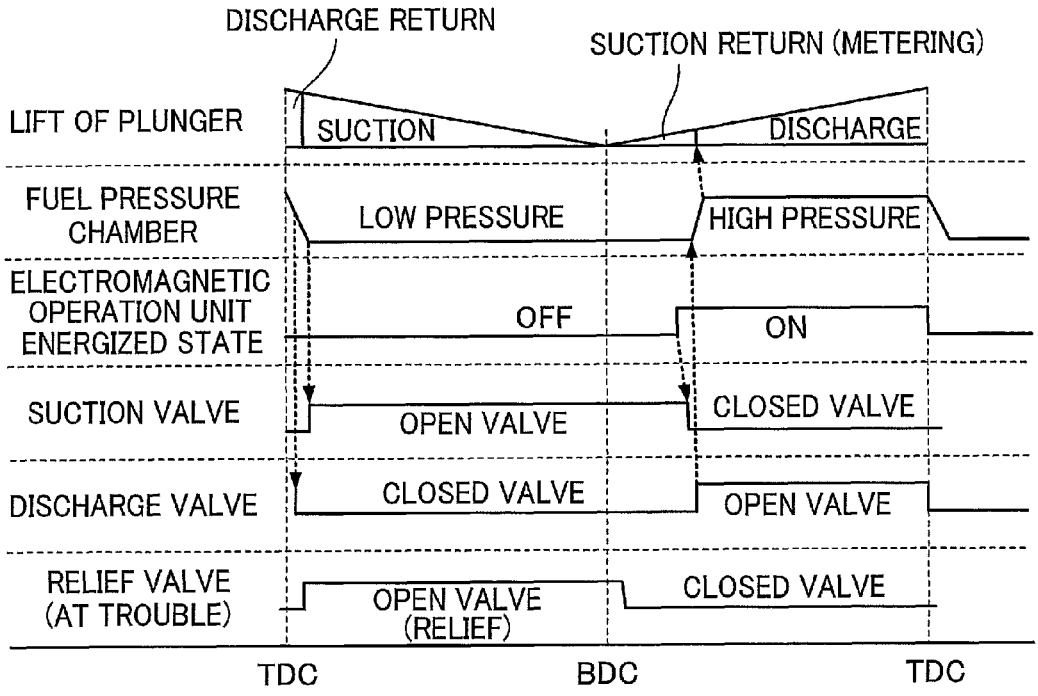
FIG. 8 is a timing chart that explains the operation of the fuel supply system of the internal combustion engine according to the first embodiment of the present invention.

When the lift amount of the plunger 12 is reduced, and the volume of the fuel pressure chamber 15 is increased as shown in FIG. 8, the discharge valve 17 having a high fuel pressure at the delivery pipe 7 side is maintained in the closed state, while the suction valve 16 is maintained in the opened state due to the electromagnetic operation unit 39 being in the deenergized state. At this time, the fuel is introduced into the fuel pressure chamber 15. When, on the other hand, the lift amount of the plunger 12 is increased, and the volume of the fuel pressure chamber 15 is decreased, the electromagnetic operation unit 39 is energized, whereupon the suction valve 16 is closed, and the fuel in the fuel pressure chamber 15 is pressurized. The pressure of the fuel pressurized in the fuel pressure chamber 15 is heightened to open the discharge valve 17. At this time, the fuel pressure level of the fuel discharged from the fuel pressure chamber 15 is for example about 4 to 20 MPa.

When the lift amount of the plunger is reduced and the volume of the fuel pressure chamber 15 is increased in the case that the fuel pressure downstream of the discharge valve 17 being extremely raised from something abnormal (troubles), the relief valve 19 is opened, so that the delivery pressure in the delivery pipe 7 can be prevented from being extremely raised according to the present embodiment. The relief valve 19 is adapted to be opened when the fuel pressure at the side of the delivery pipe 7 reaches the extremely high fuel pressure level exceeding the usually pressurized fuel pressure level. Here, the symbol "TDC" indicates an upper dead point position (maximum lift position), while the symbol "BDC" indicates a lower dead point position (minimum lift position) in FIG. 8.

On the other hand, the electromagnet coil 38 of the electromagnetic operation unit 39 is deenergized by the ECU 100 in the period except for the closed period of the suction valve 16 (the energization state OFF in FIG. 8). Under these conditions, the operation member 37 of the electromagnetic operation unit 39 is subject to the urging force of the compression coil spring 37*k* to open the suction valve 16, so that the suction valve 16 is operated to be opened by the pressing force from the operation member 37.

Next, the operation of the fuel pump 10 according to the present embodiment will be described hereinafter.

The fuel pump 10 and the fuel supply system 1 according to the present embodiment as previously mentioned are operated with the outer end portion 12*b* of the plunger 12 inputted with the power from the drive cam Dc provided with the engine 2 and lubricated by the oil in the engine 2 in the state that the pump body 11 is mounted on the outer wall portion BL of the engine 2. Therefore, the oil seal holder 25 of the pump body 11 and the lower end portion of the cylindrical portion 24*a* of the cup-shaped member 24 adjacent to the oil seal holder 25 come to receive heat through the heat conduction of heat generated from the outer wall portion BL of the engine 2, the heat conduction of the heat generated at the outer end portion 12*b* of the plunger 12 in response to the inputted power to the plunger 12 from the drive cam Dc, the head conduction from the lubricating and cooling oil in the engine 2 which comes to be raised to an extremely high temperature in comparison with the temperature of the fuel, and the like. This means that the oil seal holder 25 and the lower end portion of the cylindrical portion 24*a* in the vicinity of the oil seal holder 25 come to be at a high temperature with the heat thus received.

Further, even in the high soaking state in which the engine 2 becomes at a high temperature for example when the engine is stopped in a high temperature state and immediately thereafter a cooling system (water cooling and air cooling) is stopped, the oil seal holder 25 of the pump body 11 and the lower end portion of the cylindrical portion 24*a* in the vicinity of the oil seal holder 25 come to be at a high temperature.

Further the fuel cut of the engine 2 or the stoppage of the high pressurized fuel injection causes the fuel in the fuel pump 10 to be in a stagnated state, thereby giving rise to the state in which the surrounding temperature of the fuel pump 10 comes to be at a high temperature. Even in the above state, the oil seal holder 25 of the pump body 11 and the lower end portion of the cylindrical portion 24*a* in the vicinity of the oil seal holder 25 can be subject to heat and become at a high temperature.

Even under the high temperature state as previously mentioned, the present embodiment thus constructed, however, can effectively suppress the fuel bubbles from being sucked into the internal suction inlets 21*i*.

More specifically, the fuel bubbles are easily generated in the suction gallery chamber 13 due to the fact that the lower side of the insertion portion 21*a* of the valve retaining member 21 is held in contact with the oil seal holder 25 becoming at a high temperature. Further, the fuel bubbles elevated by buoyancy are easily collected and stored at the upper side of the insertion portion 21*a* of the valve retaining member 21. However, the fuel bubbles are difficult to be collected and stored in the vertically intermediate height area Z1 of the suction gallery chamber 13 although the fuel bubbles pass through this height area Z1 while being elevated by buoyancy. This means that the vertically intermediate height area Z1 of the suction gallery chamber 13 becomes an area having a small amount of fuel bubbles. Further, the progression pathways of the fuel bubbles rising by buoyancy after being generated at the upper surface side portion 25*a* of the oil seal holder 25 is directed by the outer peripheral surface 21*f* of the insertion portion 21*a* of the valve retaining member 21 to be away from the internal suction inlets 21*i* positioned inwardly of the valve retaining member 21. It will therefore be understood that the fuel bubbles can be effectively suppressed from being sucked into the internal suction inlets 21*i*, for example, at the high temperature restarting time of the engine 2 and at the returning time from the fuel cut.

Further, the internal suction inlets 21*i* formed in the insertion portion 21*a* of the valve retaining member 21 in the present embodiment can be disposed at any positions in the axial and circumferential directions of the valve retaining member 21. The internal suction inlets 21*i* can easily be arranged at desirable respective positions spaced apart from each other and out of the progression pathways of the fuel bubbles.

In addition, the pump body 11 in the present embodiment has the cylindrical portion 24*a* surrounding the suction gallery chamber 13 among the upper surface side portion 25*a* of the oil seal holder 25, the lid portion 24*b* of the cup-shaped member 24, and the resilient film member 26. The insertion portion 21*a* of the valve retaining member 21 is constructed to penetrate the cylindrical portion 24*a* of the cup-shaped member 24. The construction of the pump body 11 as previously mentioned can facilitate assembling of the pressure pump mechanism 20 and machining of the internal suction inlets 21*i*, etc. to the pump body 11, thereby making it possible to facilitate parts machining operations. Even more, it is possible not only to reduce unnecessary elements and parts to be thickened by carrying out the works of boring passages in many directions to the constitutional elements and parts of the pump body 11, but also to form a suction gallery chamber having a relatively large volume even for the fuel pump 10 of a small size. It will therefore be appreciated that the fuel bubbles can effectively be suppressed from being sucked into the internal suction inlets 21 by the pump body 11 constructed and produced as previously mentioned.

In particular, in the present embodiment, the progression pathways of the fuel bubbles rising by buoyancy is reliably directed by the bubble guiding surface 51 of the guiding portion 50 to be away from the internal suction inlets 21*i*. Further, the inside portion of the suction gallery chamber 13 is divided by the partition plate 52 into the bubble suppression area Z2 close to the internal suction inlets 21*i* and the bubble accommodation area Z3 remote from the internal suction inlets 21*i*. This means that the amount of fuel bubbles existing in the vicinity of the internal suction inlets 21*i* is extremely decreased. Therefore, the fuel bubbles can even more effectively be suppressed from being sucked into the internal suction inlets 21*i*.

The partition plate 52 of the guide portion 50 is attached to the outer shell member 23 forming a main body portion of the pump body 11, thereby resulting in facilitating the passage drilling works and other machining operations, and making it possible to effectively form the bubble guiding surface 51 of the guide portion 50.

Moreover, the present embodiment is constructed to have the internal suction inlets 21*i* arranged at the respective positions spaced apart from the inner wall surface 23*a* of the outer shell member 23 along which the fuel bubbles are easy to elevate by buoyancy, thereby making it possible to facilitate disposing the internal suction inlets 21*i* away from the progression pathways of the fuel bubbles rising along with the inner peripheral surface 24*i* of the cylindrical portion 24*a* of the cup-shaped member 24.

In addition to the dispositions of the internal suction inlets 21*i* in the bubble suppression area Z2 having an extremely small amount of the fuel bubbles in the present embodiment, the inner peripheral surface 24*i* of the cylindrical portion 24*a* and the pair of parallel cut surfaces 21*fa* of the valve retaining member 21 can function as bubble guiding surfaces other than the bubble guiding surface 51 that suppresses the fuel bubbles from being moved toward the internal suction inlets 21*i*. Therefore, the fuel bubbles can even more effectively be suppressed from being sucked into the internal suction inlets 21*i*.

Further, the insertion portion 21*a* of the pump mechanism 20 has the suction valve 16 and the discharge valve 17 accommodated therein and is formed with the suction passage 11*a* and the discharge passage 11*b*, thereby making it possible to drastically reduce the passage drilling works of the pump body 11, and thus to be facilitated for the machining works of the pump body 11.

Further, the fuel supply system 1 of the internal combustion engine according to the present invention is constructed to employ the fuel pump 10 which can effectively suppress the fuel bubbles from being sucked into the fuel pressure chamber 15 and can achieve a stable fuel pressure property, thereby making it possible to prevent the supply property of the pressurized fuel to the delivery pipe 7 from being reduced without fail.

As will be understood from the foregoing description, the present embodiment can provide the fuel pump 10 which is constructed to have the internal suction inlets 21*i* disposed at the respective positions away from the progression pathways of the fuel bubbles within the intermediate height area Z1 having a small amount of fuel bubbles in the suction gallery chamber 13, thereby making it possible to effectively suppress the fuel bubbles from being sucked into the fuel pressure chamber 15 and to achieve a stable fuel pressure property. Further, the present embodiment can provide a fuel supply system 1 of the internal combustion engine having a heightened supply property of the pressurized fuel by employing the fuel pump 10 thus constructed.

Second Embodiment

Figure 9:
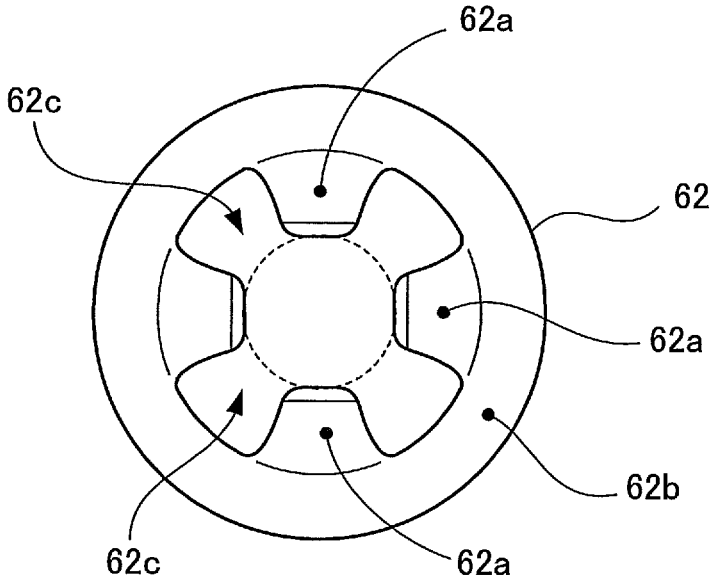
FIG. 9 is a plan view of a partition plate forming part of a guide portion in a fuel pump according to a second embodiment of the present invention.

FIG. 9 shows a construction of an essential portion forming part of the fuel pump according to the second embodiment of the present invention.

The above embodiment has been explained about the case in which the partition plate 52 of the guide portion 50 is, as shown in FIGS. 7A and 7B, in an annular shape, or in a horseshoe shape, in a roughly U-shape, or in an arcuate shape which is closed at the side of the internal suction inlets 21*i* and open at the side opposite to the internal suction inlets 21*i*, however, the partition plate 52 described in the first embodiment is replaced by a bubble suppression plate 62 shown in FIG. 9 according to the present embodiment.

In the present embodiment, only the construction of the guide portion for suppressing the progression pathways of the fuel bubbles rising by buoyancy to within a specified range is different from that of the foregoing first embodiment, but other constructions of the second embodiment are the same as those of the first embodiment. Therefore, the following explanation about the constructions the same as or similar to the constructions of the first embodiment will be made with the reference numerals and symbols indicative of the constitutional elements or parts shown in FIGS. 1 to 7 in the first embodiment, and only the points and aspects of the present embodiment different from those of the first embodiment will be explained in detail hereinafter.

In the present embodiment, the bubble suppression plate 62 has a plurality of nail portions 62*a* to be mounted and engaged with the cylinder member 22, and a guide surface portion 62*b*. The guide surface portion 62*b* is in an annular shape flat or inclined at the inner peripheral side upwardly bent and positioned around the nail portions 62*a*. The annular guide surface portion 62*b* is formed and positioned to enable the progression pathways to be suppressed within the area specified horizontally in the suction gallery chamber 13. The bubble suppression plate 62 is provided to divide the inside portion of the suction gallery chamber 13 into a bubble suppression area Z2 and a bubble accommodation area Z3. The bubble suppression area Z2 is for allowing the fuel bubbles to be suppressed from entering the bubble suppression area Z2 from the upper surface side portion 25*a* of the oil seal holder 25, while the bubble accommodation area Z3 is for allowing the fuel bubbles to be temporally accommodated therein, thereby making it possible to let the fuel bubbles naturally vanished.

The bubble suppression plate 62 has a plurality of slit portions 62*c* circumferentially between the nail portions 62*a*. The bubble suppression plate 62 can be positioned to have a large gap between the bubble suppression plate 62 and the lower portion of the insertion portion 21*a* of the valve retaining member 21 at the left side in FIG. 9, and a small gap between the bubble suppression plate 62 and the lower portion of the insertion portion 21*a* of the valve retaining member 21 at the right side in FIG. 9. The bubble suppression plate 62 thus constructed and arranged makes it difficult for the fuel bubbles generated at the upper surface side portion 25*a* of the oil seal holder 25 to enter the bubble suppression area Z2.

The present embodiment can easily dispose the internal suction inlets 21*i* at the positions out of the progression pathways in the intermediate height area Z1 in which the amount of the fuel bubbles existing in the suction gallery chamber 13 becomes decreased, thereby making it possible to provide a fuel pump 10 which can effectively suppress the fuel bubbles from being sucked into the fuel pressure chamber 15, and can achieve a stable fuel pressure property. Further, the present embodiment can provide a fuel supply system 1 of the internal combustion engine having a heightened supply property of the pressurized fuel by employing the fuel pump 10 thus constructed.

Third Embodiment

Figure 10:
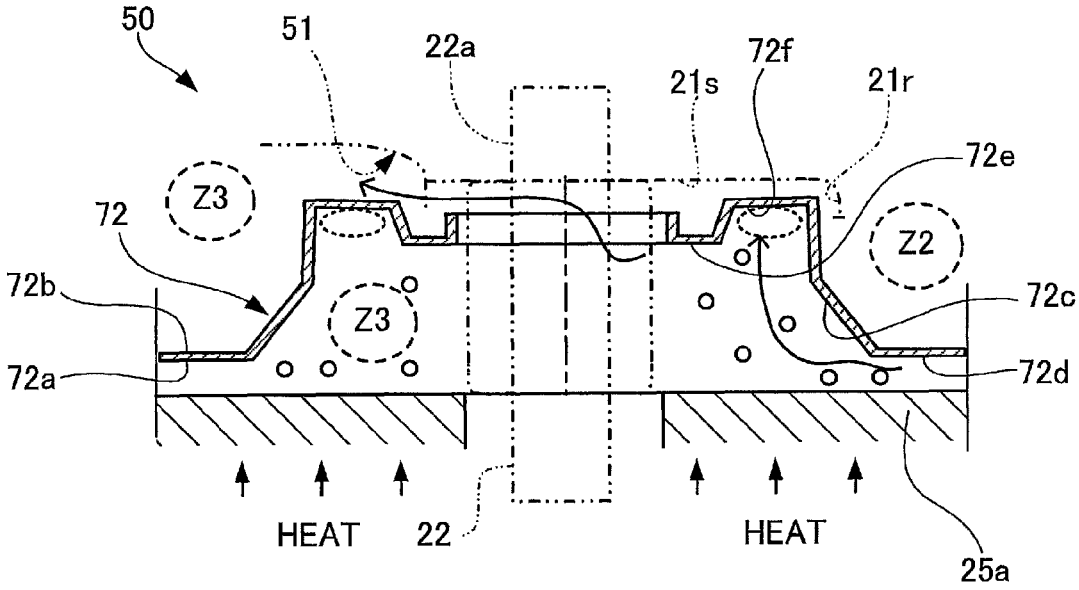
FIG. 10 is an enlarged cross-sectional view of a partition plate forming part of a guide portion in a fuel pump according to a third embodiment of the present invention.

FIG. 10 shows a construction of an essential portion forming part of the fuel pump according to the third embodiment of the present invention.

The present embodiment is constructed with a partition plate 72 which is shown in FIG. 10 to replace the partition plate 52 in the first embodiment.

The embodiments appearing hereinafter are each constructed to have a guide portion different in construction from the previously mentioned first embodiment similarly to the second embodiment except for other constructions the same as those of the first embodiment. Therefore, the following explanation about the constructions the same as or similar to the constructions of the first embodiment will be made with the reference numerals and symbols indicative of the constitutional elements or parts shown in FIGS. 1 to 7 in the first embodiment, and only the points and aspects of the present embodiment different from those of the first embodiment will be explained in detail hereinafter.

In the present embodiment, the partition plate 72 is disposed at the lower side of the inside portion of the suction gallery chamber 13 around the cylinder member 22. The partition plate 72 has vertically a lower surface 72*a* facing the upper surface side portion 25*a* of the oil seal holder 25, and an upper surface 72*b* facing the insertion portion 22*a* of the cylinder member 22.

The lower surface 72*a* of the partition plate 72 is constituted by an inclined guide surface portion 72*c* bent and inclined in the form of a truncated cone outer peripheral surface, a lower side guide surface portion 72*d* connected with the lower end of the inclined guide surface portion 72*c* and extending radially outwardly, an upper side guide surface portion 72*e* extending toward the inside of the concave section 21*s* of the valve retaining member 21 from the upper end of the inclined guide surface portion 72*c*, and a bubble accommodation portion 72*f* formed with a downward annular concave portion open toward the upper surface side portion 25*a* of the oil seal holder 25 between the inclined guide surface portion 72*c* and the upper side guide surface portion 72*e*.

The lower surface 72*a* of the partition plate 72 is positioned to have the fuel bubbles collide with one another at the positions spaced apart from the internal suction inlets 21*i* when the fuel bubbles generated at the upper surface side portion 25*a* of the oil seal holder 25 elevates by buoyancy. The progression pathways of the fuel bubbles are directed toward the bubble accommodation portion 72*f* where the fuel bubbles are collected. The fuel bubbles thus collected are directed toward the left upper side in FIG. 10, viz., in the direction away from the internal suction inlets 21*i* while passing through the inside of the concave section 21*s* of the valve retaining member 21 even if the vapor amount of the fuel in the bubble accommodation portion 72*f* exceeds a predetermined amount.

The partition plate 72 is constructed to divide the inside portion of the suction gallery chamber 13 into the bubble suppression area Z2 in which the fuel bubbles generated at the upper surface side portion 25*a* of the oil seal holder 25 are suppressed from entering the bubble suppression area Z2, and the bubble accommodation area Z3 in which the fuel bubbles are accommodated and naturally vanished at the time when the state of the fuel bubbles is changed. The internal suction inlets 21*i* formed in the insertion portion 21*a* of the valve retaining member 21 are disposed within the range of the bubble suppression area Z2.

The lower surface 72*a* of the partition plate 72 and the groove-like concave section 21*s* of the valve retaining member 21 constitutes as a whole a bubble guiding surface 51 of the guide portion 50. The bubble guiding surface 51 thus constructed can restrict the fuel bubbles rising by buoyancy from the upper surface side portion 25*a* of the oil seal holder 25 to the progression pathways of the fuel bubbles away from the internal suction inlets 21*i*, thereby making it possible to suppress the fuel bubbles from being sucked into the internal suction inlets 21*i*.

In the present embodiment, the partition plate 72 has the bubble accommodation portion 72*f* formed therein, however, it is considered that the bubble accommodation portion is formed in the bubble retaining member 21 or the outer shell member 23. It is further considered that the bubble accommodation portion 72*f* is divided into a plurality of sections, or otherwise plural kinds of bubble accommodation portions are provided.

The present embodiment can easily dispose the internal suction inlets 21*i* at the positions out of the progression pathways in the intermediate height area Z1 in which the amount of the fuel bubbles existing in the suction gallery chamber 13 becomes decreased, thereby making it possible to provide a fuel pump 10 which can effectively suppress the fuel bubbles from being sucked into the fuel pressure chamber 15, and can achieve a stable fuel pressure property. Further, the present embodiment can provide a fuel supply system 1 of the internal combustion engine having a heightened supply property of the pressurized fuel by employing the fuel pump 10 thus constructed.

Fourth Embodiment

Figure 11:
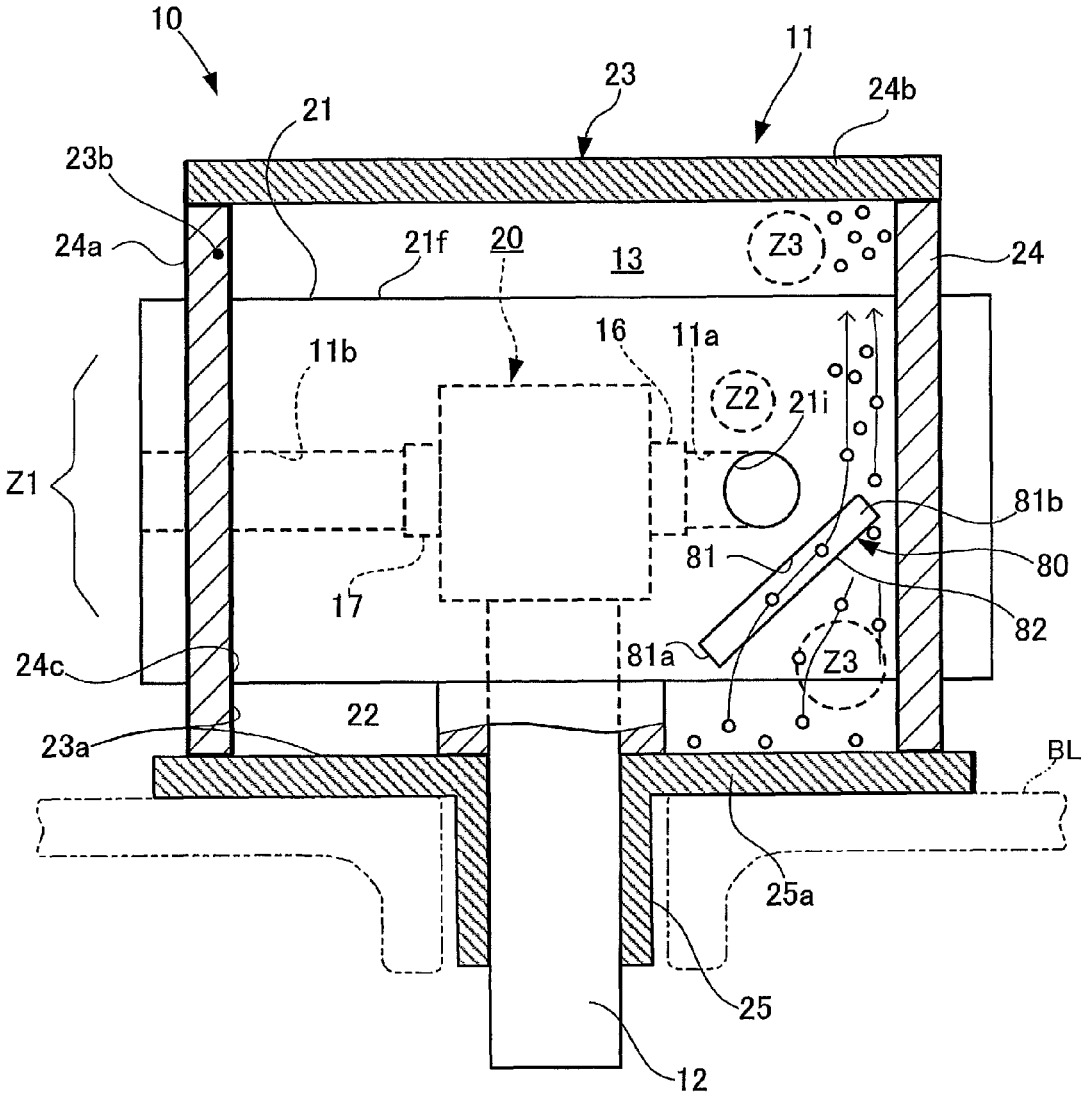
FIG. 11 is a schematic front cross-sectional view of a fuel pump according to a fourth embodiment according to the present invention.

FIG. 11 shows a schematic construction of the fuel pump according to the fourth embodiment of the present invention.

The present embodiment is constructed with a guide portion 80 which is shown in FIG. 11 to replace the guide portion 50 in the first embodiment.

Similarly to the first embodiment, the present embodiment is constructed to have the suction gallery chamber 13 defined by the outer shell member 23, the insertion portion 21*a* of the valve retaining member 21, and the cylinder member 22, and to have the fuel pressure chamber 15 formed by the insertion portions 21*a*, 22*a* of the valve retaining member 21 and the cylinder portion 22, and the plunger 12.

The valve retaining member 21 has internal suction inlets 21*i* at positions radially spaced apart from the inner peripheral surface 24*i* of the cylindrical portion 24*a* of the pump body 11. The internal suction inlets 21*i* is positioned horizontally inwardly of the inner peripheral surface 24*i* of the cylindrical portion 24*a*. The insertion portion 21*a* of the valve retaining member 21 is provided with a guide portion 80 positioned in the vicinity of the internal suction inlets 21*i*.

The guide portion 80 as shown in FIG. 11 has a bubble guiding surface 81 extending in an inclined up-down direction along the outer peripheral surface 21*f* of the insertion portion 21*a* of the valve retaining member 21 from one end portion 81*a* to the other end portion 81*b*. The one end portion 81*a* of the guide portion 80 is positioned downwardly of the internal suction inlets 21*i* and radially inwardly of the inner peripheral surface 24*i* of the cylindrical portion 24*a* from the internal suction inlets 21*i*. The other end portion 81*b* of the guide portion 80 is positioned upwardly of the internal suction inlets 21*i* and radially outwardly of the inner peripheral surface 24*i* of the cylindrical portion 24*a* from the internal suction inlets 21*i*.

The bubble guiding surface 81 is for example a side wall surface occupying a vertically upper side in a bubble guiding groove 82 extending in the inclined up-down direction along the outer peripheral surface 21*f* of the insertion portion 21*a* of the valve retaining member 21. The bubble guiding surface 81 may be a side wall surface occupying a vertically lower side in a bubble guiding ridge extending in the inclined up-down direction along the outer peripheral surface 21*f* of the insertion portion 21*a* of the valve retaining member 21, or otherwise may be an outer peripheral stepped surface extending in the inclined up-down direction along the outer peripheral surface 21*f* of the insertion portion 21*a* of the valve retaining member 21.

The present embodiment can easily dispose the internal suction inlets 21*i* at the positions out of the progression pathways in the intermediate height area Z1 in which the amount of the fuel bubbles existing in the suction gallery chamber 13 becomes decreased, thereby making it possible to provide a fuel pump 10 which can effectively suppress the fuel bubbles from being sucked into the fuel pressure chamber 15, and can achieve a stable fuel pressure property. Further, the present embodiment can provide a fuel supply system 1 of the internal combustion engine having a heightened supply property of the pressurized fuel by employing the fuel pump 10 thus constructed.

In addition, the present embodiment can effectively guide the fuel bubbles rising along the outer peripheral surface of the insertion portion 21*a* of the valve retaining member 21 of the pressure pump mechanism 20 in the direction away from the internal suction inlets 21*i* and adjacent to the inner peripheral surface 24*i* of the cylindrical portion 24*a* (radially outwardly) along with the bubble guiding surface 81 (extending direction of the bubble guiding groove 82 or the bubble guiding ridge).

Further, the guide portion 80 can guide the fuel bubbles generated on the upper surface side portion 25*a* of the oil seal holder 25 in the direction away from the internal suction inlets 21*i* with the bubble guiding surface 81 and the inner peripheral surface 24*i* of the cylindrical portion 24*a* both of which are used in combination, thereby making it possible to simply construct the guide portion 80.

Although the above embodiments have been explained with the plunger 12 vertically reciprocated, the present invention of course includes a construction in which the plunger 12 is inclined at a relatively large angle against the vertical direction, and the fuel pump 10 is arranged to be inclined with respect to the engine 2. In this construction, it is preferable that the internal suction inlets 21*i* are formed in the end portion side lower in height in the both end portions of the valve retaining member 21, while the bubble accommodation area Z3 is formed in the end portion side higher in height in the both end portions of the valve retaining member 21.

From the reason that the fuel vapor is easily generated in the fuel close to the upper surface side portion 25*a* of the oil seal holder 25 forming a lower side wall portion under the state that the feed pump 5 is stopped with the fuel introduced in and discharged out of the suction gallery chamber 13 being stopped in the foregoing embodiments, the present invention is focused exclusively to the fuel bubbles rising by buoyancy and the guide surface of the fuel bubbles, however, the present invention can of course dispose the progression pathways and the guide surface of the fuel bubbles in consideration of the flow (movement) and the restriction of the flow of the fuel in the suction gallery chamber 13.

While the above embodiments have been explained about the case that the upper surface side portion 25*a* of the oil seal holder 25 and the lower end portion of the cylindrical portion 24*a* of the cup-shaped member 24 in the vicinity of the upper surface side portion 25*a* of the oil seal holder 25 are assumed to be wall portions high in temperature, there is a possibility that the sections especially being high in temperature depending upon the arrangement environment of the fuel pump 10 become specific sections in the circumferential direction of the cylindrical portion 24*a* of the cup-shaped member 24. In this construction, needless to say, it is desirable that the internal suction inlets 21*i* are disposed at the positions away from the specific sections in the axial direction of the valve retaining member 21. The above embodiments have been explained with the upper wall portions, i.e., the lid portion 24*b* of the cup-shaped member 24 and the resilient film member 26 serving as lower temperature wall portions. However, the upper wall portions are considered to become at a high temperature depending upon the arrangement environment of the fuel pump 10 due to the heat received from the high temperature member in the vicinity of the upper wall portions. This means that the upper wall portions of the pump body 11 are not necessarily the lower temperature wall portions.

From the foregoing description, it will be appreciated that the fuel pump according to the present invention is constructed to have the internal suction inlets formed in the insertion portion of the pressure pump mechanism, thereby making it possible to facilitate disposing the internal suction inlets at the positions away from the progression pathways of the fuel bubbles in the intermediate height area having a small amount of fuel bubbles distributed. The present invention can provide a fuel pump which can effectively suppress the fuel bubbles from being sucked into the fuel pressure chamber, and to achieve a stable fuel pressure property. Further, the present invention can provide a fuel supply system which has a heightened supply property of the pressurized fuel by employing the fuel pump 10 thus constructed. The present invention is useful in the whole of the fuel pump suitable for pressurizing the fuel to a sufficiently high pressure to inject the fuel into the cylinder of the internal combustion engine and the fuel supply system of the internal combustion engine with the fuel pump mounted thereon.

REFERENCE SIGNS LIST

1: fuel supply system
2: engine (internal combustion engine)
10: fuel pump
11: pump body
11*a*: suction passage (fuel introduction passage)
11*b*: discharge passage
12: plunger
12*b*: outer end portion (input portion)
13: suction gallery chamber (fuel storage chamber)
15: fuel pressure chamber
20: pressure pump mechanism
21: valve retaining member
21*a*: insertion portion
21*c*: axially intermediate portion
21*f*: outer peripheral surface
21*fa*: parallel cut surface
21*h*: valve accommodating bore (pump operation chamber)
21*i*: internal suction inlet
23: outer shell member (main body of pump body)
23*b*: inner wall portion
24: cup-shaped member
24*a*: cylindrical portion (peripheral wall portion)
24*b*: lid portion (upper side wall portion)
24*i*: inner peripheral surface
25: oil seal holder
25*a*: upper surface side portion (lower side wall portion)
26: resilient film member (upper side wall portion)
50; 80: guide portion
51; 81: bubble guiding surface
52; 72 partition plate
62: bubble suppression plate
72*f*: bubble accommodation portion
82: bubble guiding groove
a1, a2: intermediate passage
Z1: intermediate height area
Z2: bubble suppression area
Z3: bubble accommodation area

The invention claimed is:

1. A fuel pump provided with a pump body and a pressure pump mechanism, the pump body being formed with a fuel introduction passage to introduce fuel from the outside and a pump operation chamber to introduce the fuel through the fuel introduction passage, and the pressure pump mechanism having an input portion having power inputted from the outside and discharging the fuel pressurized in a fuel pressure chamber formed in the pump operation chamber when the power is inputted to the input portion, the pump body having a fuel storage chamber forming part of the fuel introduction passage, a lower side wall portion positioned at a vertically lower side of an inner wall portion partly forming the fuel storage chamber, and an upper side wall portion positioned at a vertically upper side of the inner wall portion partly forming the fuel storage chamber, the pressure pump mechanism having an insertion portion inserted in the fuel storage chamber of the pump body to be positioned vertically between the lower side wall portion and the upper side wall portion of the pump body, the insertion portion having an internal suction inlet in the vertically intermediate height area in the fuel storage chamber to suck the fuel into the pump operation chamber from the fuel storage chamber.

2. In the fuel pump as set forth in claim 1, in which the lower side wall portion receives heat from the outside to become a high temperature side wall portion in the pump body.

3. In the fuel pump as set forth in claim 1, in which the pump body has a peripheral wall portion surrounding the circumference of the fuel storage chamber between the lower side wall portion and the upper side wall portion, and the insertion portion of the pressure pump mechanism is constructed to penetrate the peripheral wall portion.

4. In the fuel pump as set forth in claim 3, in which at least one of the insertion portion of the pressure pump mechanism and the pump body is provided with a guide portion to guide bubbles generated and rising at the lower side wall portion in the direction different from the direction in which the bubbles are moved toward the internal suction inlet.

5. In the fuel pump as set forth in claim 4, in which the guide portion has a guide surface intersecting with at least the wall surface portion positioned in the vicinity of the internal suction inlet in the inner peripheral wall surface of the peripheral wall portion of the pump body.

6. In the fuel pump as set forth in claim 4, in which the guide portion is constituted by a groove or a ridge provided at the insertion portion of the pressure pump mechanism.

7. In the fuel pump as set forth in claim 1, in which the insertion portion of the pressure pump mechanism accommodates therein a suction valve to be opened to allow the suction of the fuel into the fuel pressure chamber, and is formed therein with a fuel discharge passage to discharge the fuel from the fuel pressure chamber to the outside.

8. In the fuel pump as set forth in claim 4, in which the pump body is mounted on the outer wall portion of an internal combustion engine, and the input portion is inputted with power from a driving member mounted on the internal combustion engine at the lower side wall portion of the pump body, the guide portion has a plate-like member disposed between the lower side wall portion and the insertion portion of the pressure pump mechanism, and the inside of the fuel storage chamber is divided into a bubble suppression area having the internal suction inlet disposed therein and a bubble accommodation area accommodating therein and disappearing fuel bubbles.

9. In the fuel pump as set forth in claim 3, in which the insertion portion of the pressure pump mechanism has the internal suction inlet at a position out of the inner peripheral surface of the peripheral wall portion in the radial direction of the peripheral wall portion of the pump body.

10. A fuel supply system of an internal combustion engine provided with the fuel pump as set forth in claim 1 comprises:

a feed pump that supplies fuel pumped up from a fuel tank to the fuel introduction passage of the fuel pump, and a delivery pipe that stores the fuel pressurized and discharged by the pressure pump mechanism and supplies the fuel to a fuel injection valve, the fuel storage chamber of the pump body having the fuel from the feed pump stored therein.

* * * * *